US006056056A

United States Patent [19]

Durst et al.

[11] Patent Number: 6,056,056

[45] Date of Patent: May 2, 2000

[54] WHIPSTOCK MILL

[76] Inventors: Douglas G. Durst, 1101 Aster St., Katy, Tex. 77493; Robert E. Robertson, 16606 Chewton Glen St., Tomball, Tex. 77375; Thurman B. Carter, 2901 Rose Heath La., Houston, Tex. 77073; Paul J. Johantges, 1802 Wynridge, Deer Park, Tex. 77536; Charles W. Pleasants, 2071 Maple Village Dr., Cypress, Tex. 77429; William A. Blizzard, Jr., 4314 Island Hills Dr., Houston, Tex. 77059; Dale E. Langford, 116 W. Bayou Shore, Lafayette, La. 70508; Guy L. McClung, III, 8130 Vinage Creek, Spring, Tex. 77379

[21] Appl. No.: 09/008,614

[22] Filed: Jan. 18, 1998

Related U.S. Application Data

[63] Continuation-in-part of application No. 08/752,359, Nov. 19, 1996, which is a continuation-in-part of application No. 08/655,087, Jun. 3, 1996, Pat. No. 5,620,051, which is a division of application No. 08/414,338, Mar. 31, 1995, Pat. No. 5,522,461, which is a continuation-in-part of application No. 08/542,439, Oct. 12, 1995, and a continuation-in-part of application No. 08/590,747, Jan. 24, 1996, and a continuation-in-part of application No. 08/683,611, Jul. 15, 1996.

[51] Int. Cl.[7] ..... E21B 29/00

[52] U.S. Cl. ..... 166/298; 166/55.7; 166/117.6

[58] Field of Search ..... 166/298, 55, 55.1, 166/55.2, 55.3, 55.6, 55.7, 117.5, 117.6; 175/80, 81

[56] References Cited

U.S. PATENT DOCUMENTS 1,524,265 1/1925 Lester ..... 294/86.22

(List continued on next page.)

FOREIGN PATENT DOCUMENTS 0733775A 9/1996 European Pat. Off. .

(List continued on next page.)

OTHER PUBLICATIONS

Int'l Search Report PCT/GB 99/00036 Counterpart of U.S. 09/008,614 filed Jan. 18, 1998.

(List continued on next page.)

*Primary Examiner*—William Nuder

[57] ABSTRACT

Wellbore apparatus has been invented that includes a whipstock with a top and a bottom, the whipstock disposed in a wellbore extending down from an earth surface into the earth, the wellbore having an inner surface, a mill guide with a body having an upper end, a lower end, and a channel therethrough from the upper end to the lower end, and a portion of the lower end of the mill guide disposed between and held between the inner surface of the wellbore and an outer surface of the top of the whipstock.

A method for stabilizing a mill guide in a wellbore extending from an earth surface into the earth has been invented, the wellbore having an inner surface, the method including setting a whipstock at a location in the wellbore, the whipstock having a top and a bottom, moving a mill guide down into the wellbore to contact the whipstock, the mill guide having a body with an upper end, a lower end, and a channel therethrough from the upper end to the lower end, and positioning the mill guide so that a portion of the lower end of the mill guide is stabilizinglyconnected to and/or received and held between the inner surface of the wellbore and an outer surface of the top of the whipstock.

A method has been invented for milling within a whipstock set in a wellbore extending from an earth surface down into the earth, the whipstock having a body with a top and a bottom, the method including introducing a mill guide into the wellbore above the whipstock, moving the mill guide into stabilizing contact with the whipstock, the mill guide having a top and a bottom and a channel therethrough from top to bottom, guiding a mill with the mill guide to mill down into the whipstock and through at least a longitudinal portion thereof, the mill having at least a portion thereof in contact with the mill guide while milling the at least a longitudinal portion of the whipstock.

19 Claims, 17 Drawing Sheets

U.S. PATENT DOCUMENTS

| | | | |
|---|---|---|---|
| 1,570,518 | 1/1926 | Mitchell | 166/117.5 |
| 1,615,037 | 1/1927 | Raymond . | |
| 1,636,032 | 7/1927 | Abbott . | |
| 1,901,453 | 3/1933 | Kelly . | |
| 1,951,638 | 3/1934 | Walker . | |
| 2,014,805 | 9/1935 | Hinderliter . | |
| 2,065,896 | 12/1936 | Keever | 175/83 |
| 2,100,684 | 11/1937 | Carroll . | |
| 2,103,622 | 12/1937 | Kinzbach . | |
| 2,105,721 | 1/1938 | Cutrer et al. . | |
| 2,105,722 | 1/1938 | Barrett et al. . | |
| 2,108,419 | 2/1938 | Trotter . | |
| 2,158,329 | 5/1939 | Kinzback . | |
| 2,196,517 | 4/1940 | Bolton . | |
| 2,216,963 | 10/1940 | Sinclair | 175/82 |
| 2,281,414 | 4/1942 | Clark . | |
| 2,331,293 | 10/1943 | Ballard . | |
| 2,362,529 | 11/1944 | Barrett et al. | 166/117.6 X |
| 2,386,514 | 10/1945 | Stokes | 175/81 |
| 2,401,893 | 6/1946 | Williams, Jr. | 175/81 |
| 2,509,144 | 5/1950 | Grable . | |
| 2,553,874 | 5/1951 | Spaulding et al. . | |
| 2,756,010 | 10/1956 | Hester | 166/217 |
| 2,770,444 | 11/1956 | Neal . | |
| 2,807,440 | 9/1957 | Beck . | |
| 2,882,015 | 4/1959 | Beck . | |
| 2,885,182 | 5/1959 | Hering | 255/1.6 |
| 2,978,032 | 4/1961 | Hanna | 166/117.5 |
| 3,095,039 | 6/1963 | Kinzback | 166/117.6 |
| 3,172,488 | 3/1965 | Roxstrom . | |
| 3,570,598 | 3/1971 | Johnson | 166/178 |
| 3,732,924 | 5/1973 | Chelette et al. | 166/55 |
| 3,872,926 | 3/1975 | VanGils | 166/301 |
| 3,908,759 | 9/1975 | Cagle et al. | 166/117.6 |
| 4,043,390 | 8/1977 | Glotin | 166/215 |
| 4,182,423 | 1/1980 | Ziebarth et al. | 175/61 |
| 4,266,621 | 5/1981 | Brock | 175/329 |
| 4,397,355 | 8/1983 | McLamore | 166/297 |
| 4,415,205 | 11/1983 | Rehm et al. | 299/5 |
| 4,420,049 | 12/1983 | Holbert | 175/45 |
| 4,696,502 | 9/1987 | Desai | 294/86.17 |
| 4,733,732 | 3/1988 | Lynch | 175/9 |
| 4,796,709 | 1/1989 | Lynde et al. | 166/55.6 |
| 4,807,704 | 2/1989 | Hsu et al. | 166/313 |
| 4,848,462 | 7/1989 | Allwin | 166/208 |
| 4,887,668 | 12/1989 | Lynde et al. | 166/55.8 |
| 4,938,291 | 7/1990 | Lynde et al. | 166/55.8 |
| 4,978,260 | 12/1990 | Lynde et al. | 166/55.6 |
| 4,984,488 | 1/1991 | Lynde et al. | 166/55.6 |
| 5,010,955 | 4/1991 | Springer | 166/298 |
| 5,014,778 | 5/1991 | Lynde et al. | 166/55.6 |
| 5,035,292 | 7/1991 | Bailey et al. | 175/45 |
| 5,038,859 | 8/1991 | Lynde et al. | 166/55.6 |
| 5,058,666 | 10/1991 | Lynde et al. | 166/55.6 |
| 5,086,838 | 2/1992 | Cassel et al. | 166/55.6 |
| 5,109,924 | 5/1992 | Jurgens et al. | 166/117.5 |
| 5,150,755 | 9/1992 | Cassel et al. | 166/297 |
| 5,199,513 | 4/1993 | Stewart et al. | 175/73 |
| 5,297,630 | 3/1994 | Lynde et al. | 166/297 |
| 5,335,737 | 8/1994 | Baugh | 175/61 |
| 5,353,876 | 10/1994 | Curington et al. | 166/313 |
| 5,373,900 | 12/1994 | Lynde et al. | 166/297 |
| 5,379,845 | 1/1995 | Blount et al. | 166/382 |
| 5,392,858 | 2/1995 | Peters et al. | 166/298 |
| 5,398,754 | 3/1995 | Dinhoble | 166/117.6 |
| 5,425,119 | 6/1995 | Sieber | 166/206 |
| 5,425,417 | 6/1995 | Carter | 166/117.6 |
| 5,427,179 | 6/1995 | Bailey et al. | 166/117.6 |
| 5,429,187 | 7/1995 | Beagrie et lal. . | |
| 5,431,220 | 7/1995 | Lennon et al. | 166/55.7 |
| 5,437,340 | 8/1995 | Lee et al. | 175/61 |
| 5,443,129 | 8/1995 | Bailey et al. | 175/45 |
| 5,445,222 | 8/1995 | Pritchard et al. | 116/298 |
| 5,452,759 | 9/1995 | Carter et al. | 166/117.6 |
| 5,456,312 | 10/1995 | Lynde et al. | 166/55.6 |
| 5,462,120 | 10/1995 | Gouduin | 166/117.6 |
| 5,467,820 | 11/1995 | Sieber | 166/117.6 |
| 5,474,126 | 12/1995 | Lynde et al. | 166/117.6 |
| 5,484,021 | 1/1996 | Hailey | 166/297 |
| 5,499,680 | 3/1996 | Walter et al. | 166/377 |
| 5,544,104 | 8/1996 | Laurel et al. | 166/117.6 |
| 5,551,509 | 9/1996 | Braddick | 166/55.7 |
| 5,564,503 | 10/1996 | Longbottom et al. | 166/313 |
| 5,566,762 | 10/1996 | Braddick et al. | 166/382 |
| 5,566,763 | 10/1996 | Williamson et al. | 166/382 |
| 5,573,064 | 11/1996 | Hisaw | 166/250.07 |
| 5,584,350 | 12/1996 | Schnitker et al. | 175/80 |
| 5,595,247 | 1/1997 | Braddick | 166/297 |
| 5,620,051 | 4/1997 | Carter et al. | 166/298 |
| 5,647,436 | 7/1997 | Braddick | 166/298 |
| 5,647,437 | 7/1997 | Braddick et al. | 166/382 |
| 5,787,978 | 8/1998 | Carter et al. | 166/117.6 |
| 5,803,176 | 9/1998 | Blizzard, Jr. et al. | 166/298 |
| 5,806,614 | 9/1998 | Nelson | 175/61 |
| 5,829,518 | 11/1998 | Gano et al. | 166/55.7 |
| 5,832,997 | 11/1998 | White et al. | 166/177.6 |
| 5,833,003 | 11/1998 | Longbottom et al. | 166/298 |
| 5,845,710 | 12/1998 | Longbottom et al. | 166/313 |

FOREIGN PATENT DOCUMENTS

| | | | |
|---|---|---|---|
| WO 95 33910 A | 12/1995 | WIPO . | |
| WO 97/45623 | 5/1997 | WIPO | E21B 33/00 |

OTHER PUBLICATIONS

"Coring Services," Weatherford, 1994.

"Casing Whipstocks," Eastman Whipstock, Composite Catalog 1976–1977, p. 2226.

"Product Catlaog," Weatherford Petco, 1992, especially pp. 26–30.

"Bowen Whipstocks," Bowen Co., Composite Catalog, 1962–1963.

"Catalog 1958–59," Kinzbach Tool Co. Inc. 1958.

"Directional Drilling Tools," Homco Associated Oil Field Rentals, Composite Catalog 1964 –1965, pp. 2391, 2392, 2394.

"Oilfield Services And Manufactured Products," Homco, 1984.

"A–Z Stub Type Whipstock," A–Z Int'l Tool Co., 1976 –1977 Composite Catalog, p. 219.

"Weatherford Fishing and Rental Tool Services," Weatherford, 1993.

"Improved Casing Sidetrack Procedure Now Cuts Wider, Longer Windows," Cagle et al, Petroleum Engr. Int'l, Mar. 1979.

"Dual Horizontal extension drilled using retrievable whipstock," Cress et al, World Oil, Jun. 1993.

"1990 –91 General Catalog," A–1 Bit & Tool Co., p. 9, 1990.

"TIW's SS–WS Whipstock Pakcer," Texas Iron Works, p. 111.9.18; 1986.

FIG. 1A1
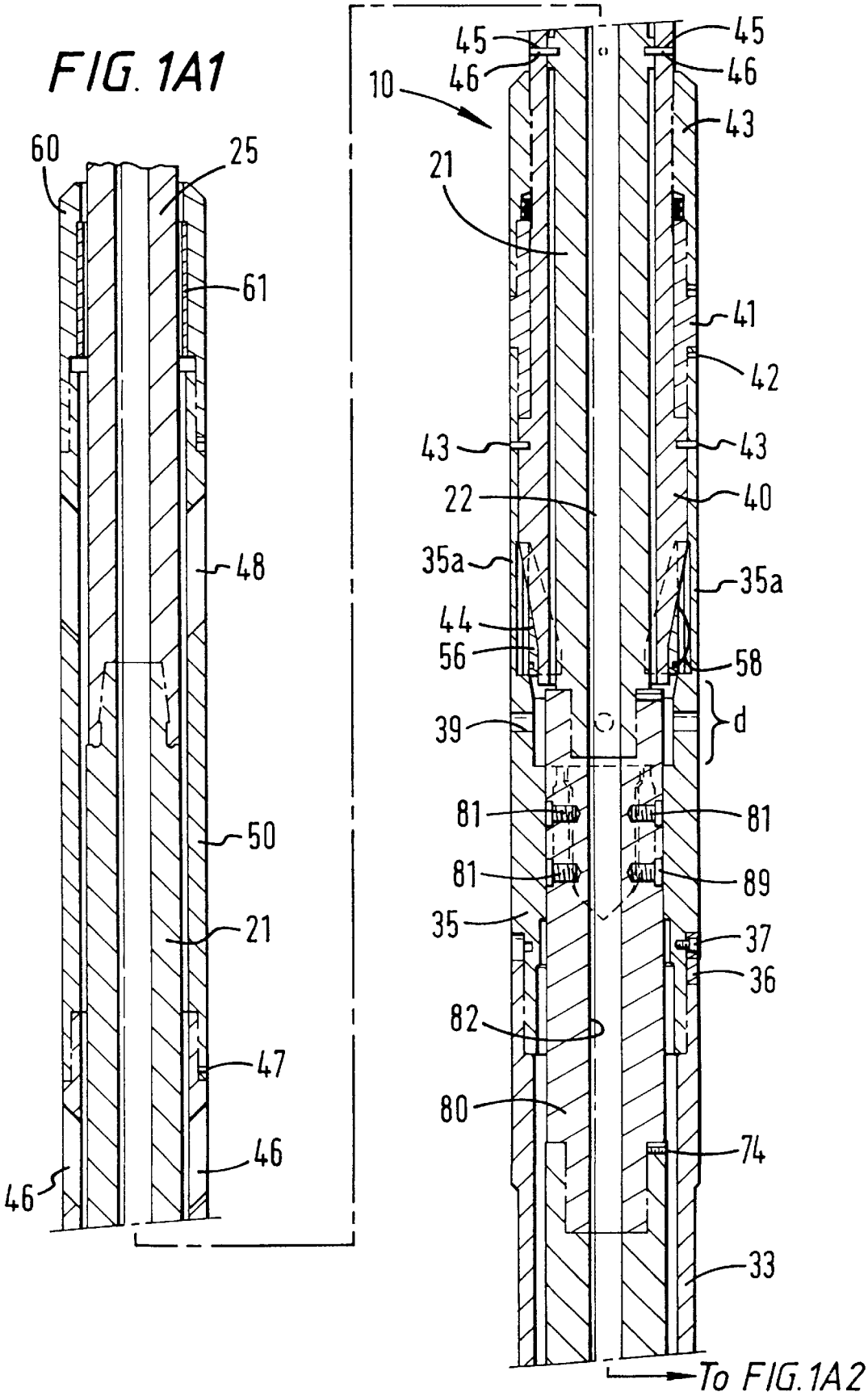

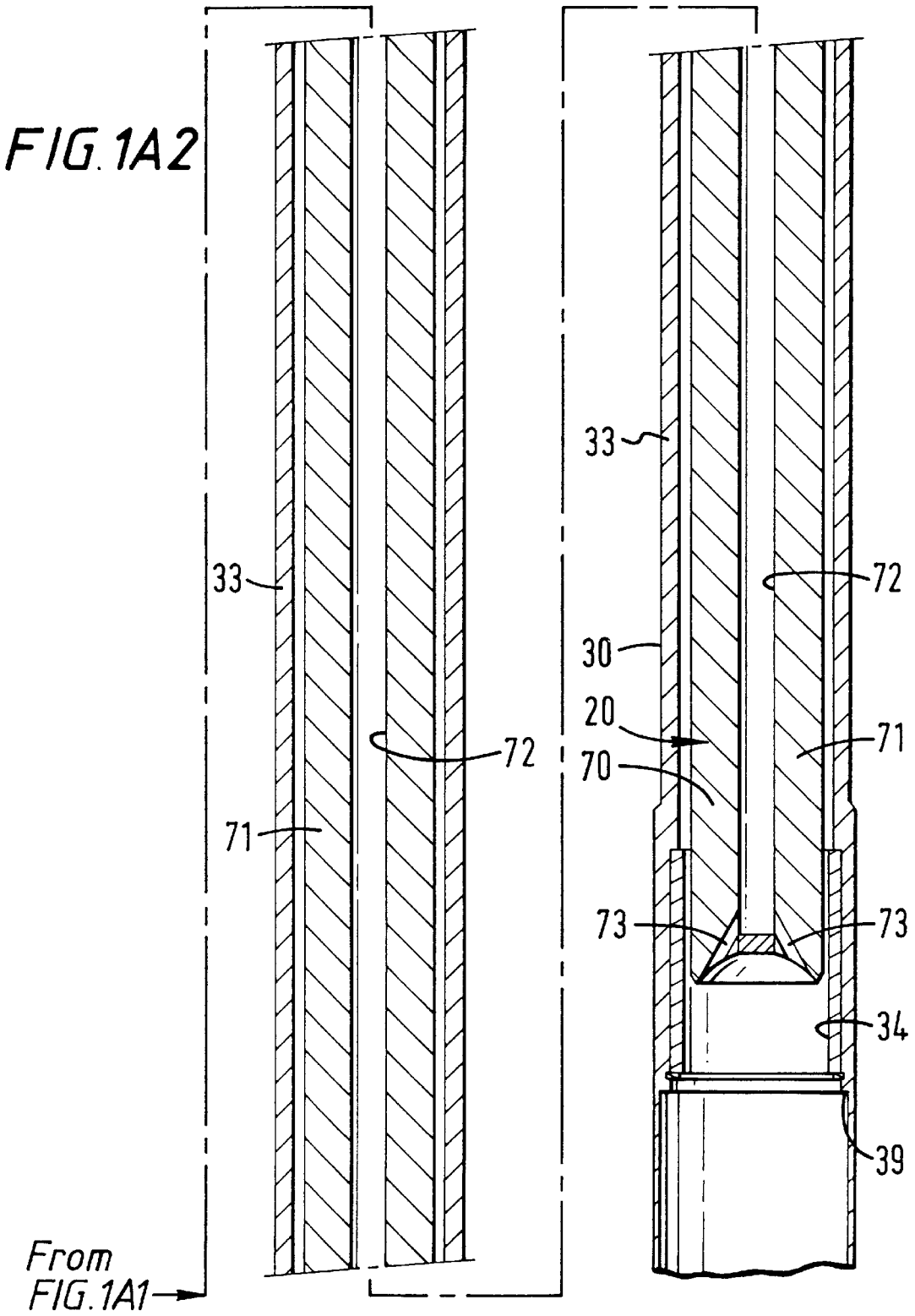
FIG. 1A2
33
72
71
From FIG. 1A1
33
72
30
20
71
70
73
73
34
39

FIG. 3D
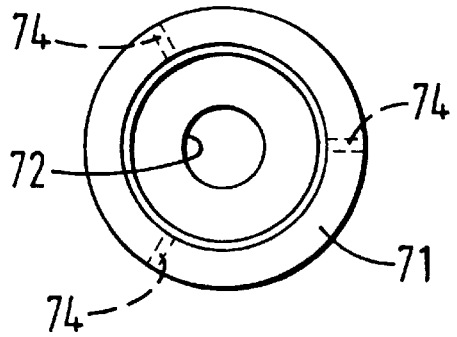
FIG. 3E
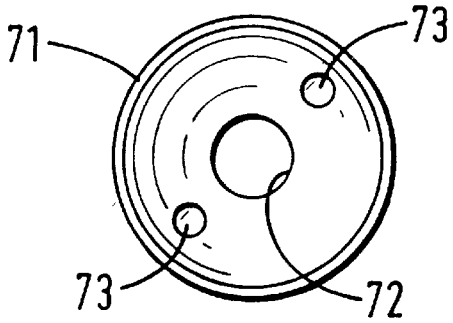
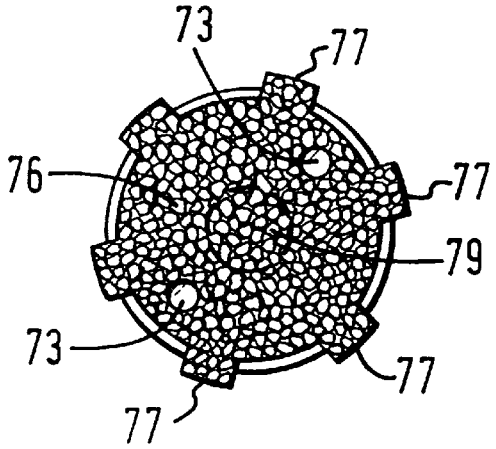
FIG. 3F
FIG. 3G
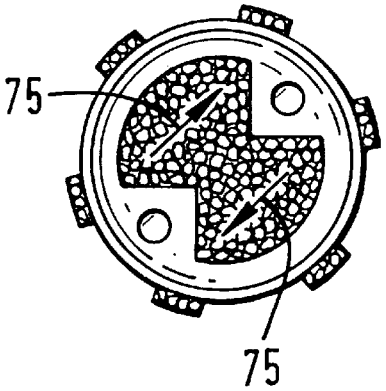
FIG. 3H
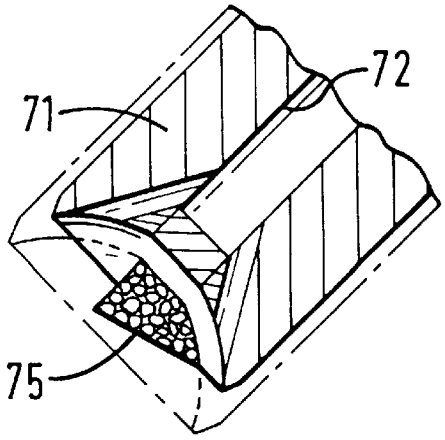

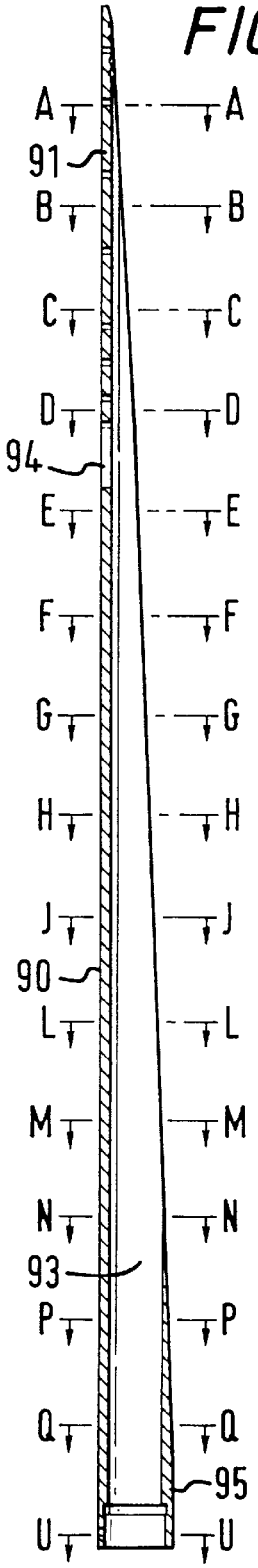
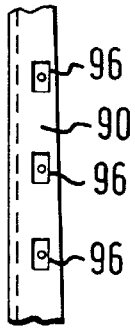
FIG. 4F
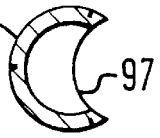
FIG. 4G
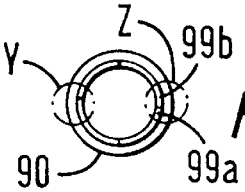
FIG. 5B
FIG. 5C
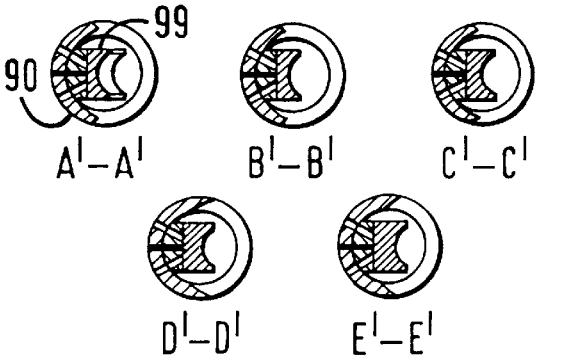
FIG. 5D
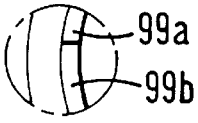
DETAIL Y
FIG. 5E
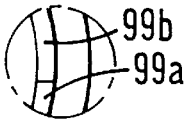
DETAIL Z
FIG. 5A
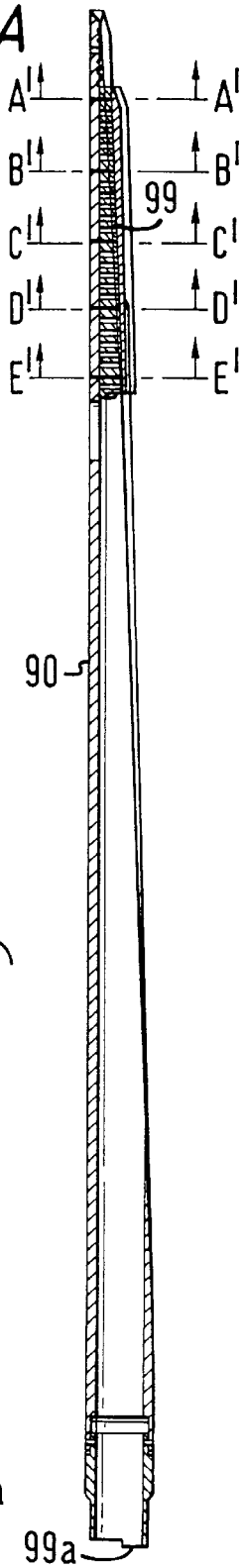

FIG. 7A
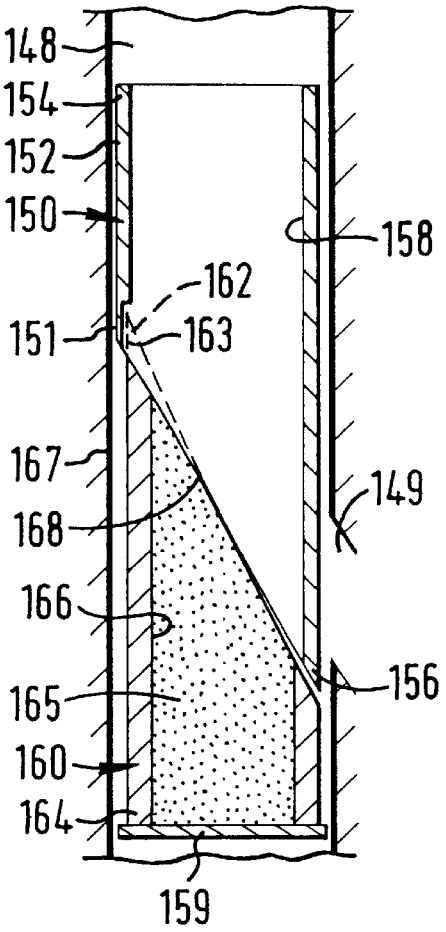
FIG. 7C
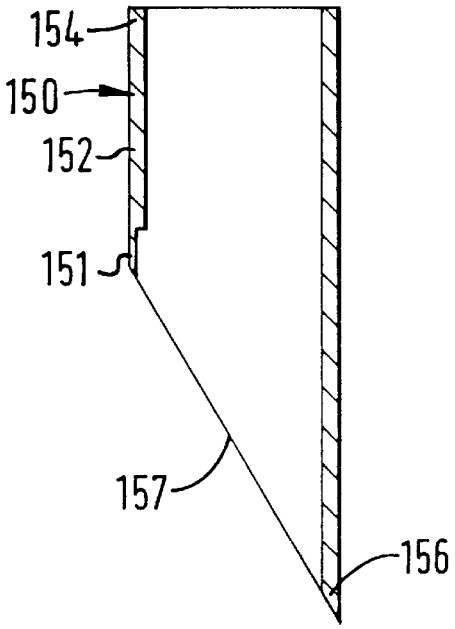
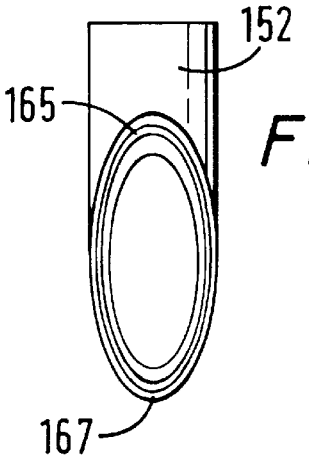
FIG. 7D
FIG. 7B
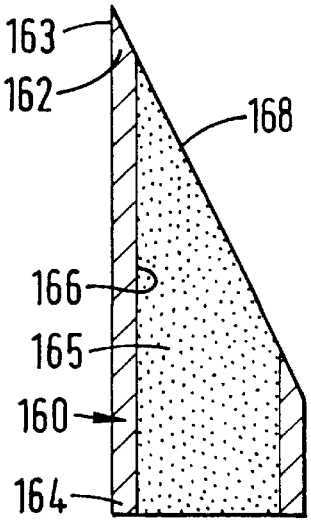
FIG. 7E
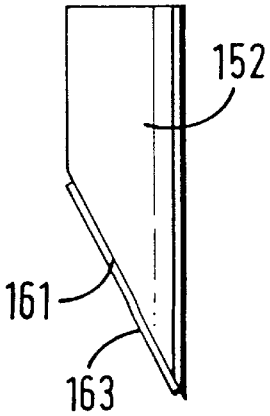

WHIPSTOCK MILL

RELATED APPLICATIONS

This is a continuation-in-part of U.S. application Ser. No. 08/752,359 filed Nov. 19, 1996, which is a continuation-in-part of U.S. application Ser. No. 08/655,087, filed Jun. 3, 1996, now U.S. Pat. No. 5,620,051 which is a division of U.S. application Ser. No. 08/414,338 filed Mar. 31, 1995, now U.S. Pat. No. 5,522,461 and which is a continuation-in-part of U.S. application Ser. No. 08/542,439 filed Oct. 12, 1995. This is a continuation-in-part of U.S. application Ser. No. 08/590,747 filed Jan. 24, 1996. This is a continuation-in-part of U.S. application Ser. No. 08/683,611 filed Jul. 15, 1996. All such applications are co-owned and are incorporated fully herein for all purposes.

BACKGROUND OF THE INVENTION

1. Field of the Invention

The present invention is directed to wellbore milling systems and operations in which the interior of a whipstock is milled out. The present invention is also directed to wellbore mills, mill guides, whipstocks, combinations thereof, and methods of their use.

2. Description of Related Art

The prior art discloses a wide variety of apparatuses and methods of their use for re-opening a pathway through a whipstock set in a wellbore. Such a whipstock or diverter may block the wellbore in which it is set and re-opening of the wellbore requires removal of the whipstock or the creation of a pathway through it.

A wide variety of U.S. patents present systems with hollow whipstocks and various systems and methods for either whipstock removal or for opening a path through a whipstock.

There has been a need for an efficient and effective system and method for opening a pathway through a whipstock in a wellbore.

SUMMARY OF THE PRESENT INVENTION

The present invention, in certain embodiments, discloses a system for milling through a whipstock in a wellbore, the system having: a mill guide with a lower shoe for emplacement between an interior surface of the wellbore and an exterior portion of a top of the whipstock to position and/or stabilize the mill guide; and, in one aspect, such a system with a mill apparatus initially releasably mounted in the mill guide and selectively releasable therefrom to mill down through the whipstock, guided by the mill guide.

In one aspect a concave portion of the whipstock has edges defined by rails that approach closer to each other from top to bottom of the concave and which are configured and positioned to receive and hold part of the mill to stabilize the mill as it moves down in and from the mill guide. In one aspect, the mill is sufficiently long that at least a portion thereof is within the mill guide when a lower portion thereof is being received between the lower part of the rails of the concave.

In certain preferred embodiments the mill guide and/or whipstock itself guide the mill so that it mills down within the whipstock rather than moving laterally to mill into and/or through a side of the whipstock or laterally into formation adjacent the whipstock.

In one aspect a mill guide is provided that has a sacrificial element therein past which the mill moves so that the mill mills the sacrificial element rather than the main body of the mill guide.

In one aspect such a system includes a selectively actuable setting mechanism to selectively set an inner mandrel within the mill guide to which a mill is releasably secured. In one aspect such a system is provided in which drill string torque is selectively isolated from certain system components. In one aspect a one-way ratchet holding system is provided to prevent undesirable release of the inner mandrel. In one aspect, such a holding system includes corresponding co-acting ratchet teeth which are shearable and/or millable in response to a known force applied thereto so that the inner mandrel can be released from the mill guide for removal and retrieval therefrom.

In certain embodiments systems according to the present invention mill out a whipstock in a single trip into the wellbore and are then retrievable therefrom.

It is, therefore, an object of at least certain preferred embodiments of the present invention to provide new, useful, unique, efficient, nonobvious mill guides, mills, apparatuses for milling through a whipstock, shoe guides for mills, guide-whipstock systems and methods of their use.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIGS. 1A1 and 1A2 present a side cross-section view of a system according to the present invention.

FIG. 3D is a top view of the mill of FIG. 3C. FIG. 3E is a bottom end view of the mill of FIG. 3C with the bottom undressed. FIG. 3F is a bottom end view of the milling apparatus of FIG. 3A. FIG. 3G is a bottom end view of the milling apparatus of FIG. 3A with some of the dressing removed. FIG. 3H is an end cross-section view of the milling apparatus of FIG. 3A.

FIG. 5A is a side cross-section view of a whipstock according to the present invention. FIG. 5B is an end view of the whipstock of FIG. 5A. FIG. 5C shows a series of cross-section views corresponding to lines indicated in FIG. 5A. FIG. 5D is an enlargement of part of FIG. 5B. FIG. 5E is an enlargement of part of FIG. 5B.

FIG. 7A is a side cross-section view of a mill guide system according to the present invention. FIGS. 7B and 7C show parts of the system of FIG. 7A. FIGS. 7D and 7E show alternative embodiments for a mill guide or guide shoe according to the present invention.

DESCRIPTION OF PREFERRED EMBODIMENTS

Figure 1B:
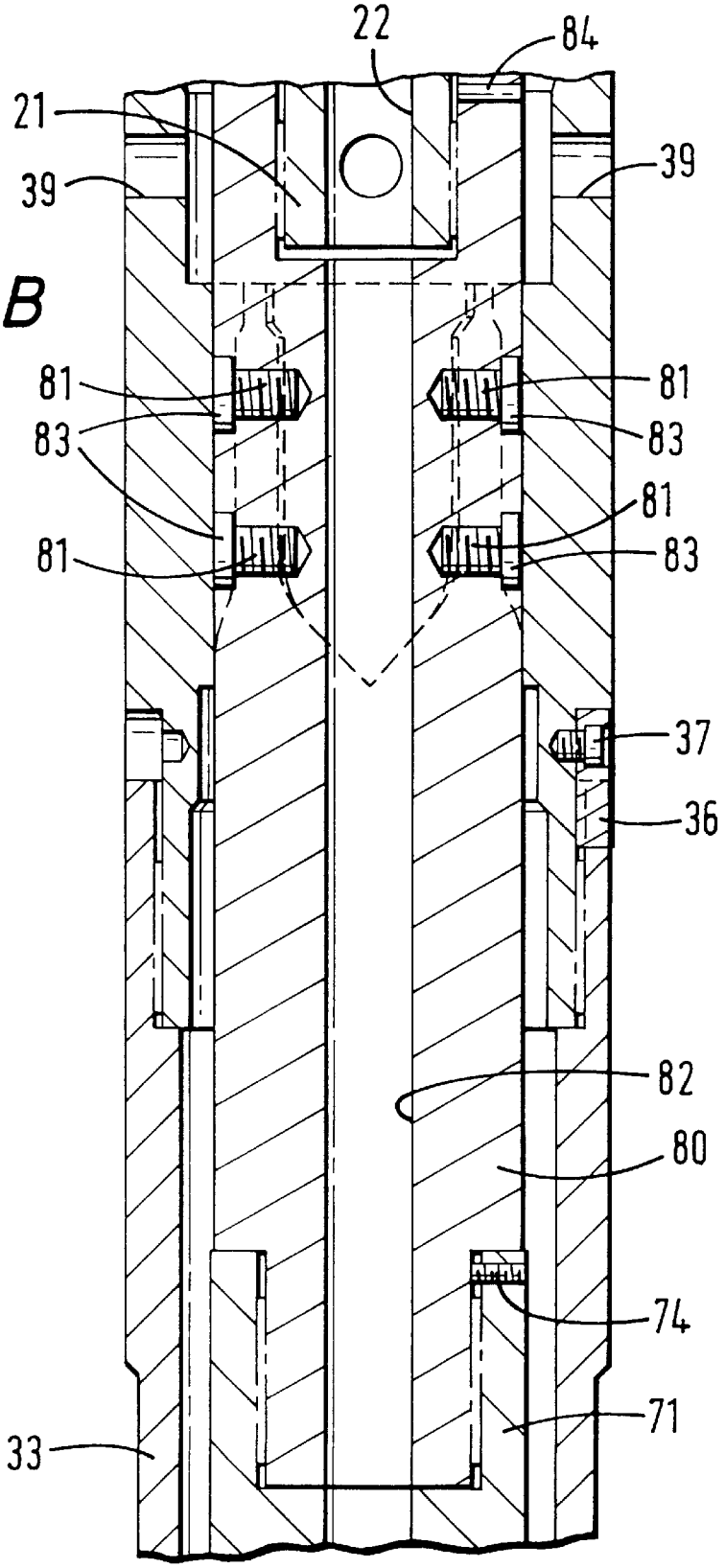
FIGS. 1B and 1C show enlargements of parts of the system of FIG. 1A.
Figure 1C:
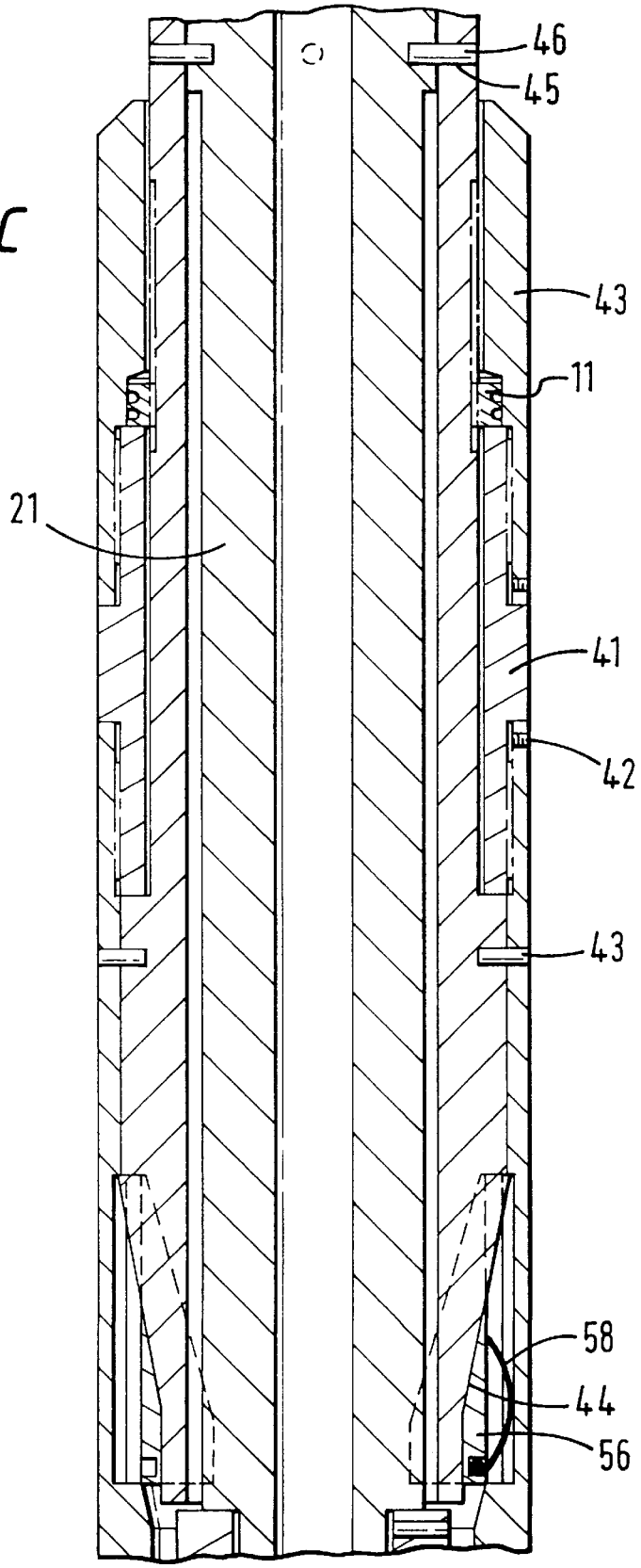

FIGS. 1A1–1C show a system 10 according to the present invention which has an inner mill apparatus 20 initially releasably disposed in a mill guide 30

The mill guide 30 has a lower shoe portion 31 with a tip 32. The lower shoe portion 31 is secured to or formed integrally of a barrel 33. The lower shoe portion 31 has a wall thickness similar to that of the barrel 33 or, as shown, the wall thickness of the lower shoe portion 31 may be less than that of the barrel 33. In one embodiment the lower shoe portion 31 has a wall thickness of about 0.20 inches and the barrel 33 has a wall thickness of about 0.625 inches. In one embodiment, as shown in FIG. 1A, the shoe portion 31 is 8.25 inches in outer diameter and about 12 inches long. The lower shoe portion 31 has a shoulder 39 which can rest on the top of a whipstock. With a twelve inch shoe portion the entire barrel 33 is about ten feet long; and with a shoe about thirty six inches long, about twelve feet long. A system 10, in certain aspects, ranges between about eighteen to about twenty feet long. In certain aspects the shoe portion 31 has a length such that the shoulder 39 (and in certain aspects the lower end of the mill itself) do not inadvertently impact the top of the whipstock thereby erroneously resulting in the shearing of shear pins in the system and/or an erroneous indication to an operator that the slips 56 have been set correctly. Thus the operator can with assurance, after correct shoe portion emplacement, pick up on the string and the system, e.g. with about 10,000 pounds force, to insure that the slips are correctly set (whereas if the shoe portion and/or mill was wedged in incorrectly, e.g. with a whipstock lug, a false reading would result indicating falsely that the slips were properly set.)

A sacrificial element 34 is secured in the barrel 33 e.g. by a holding ring 9 which can be a snap ring or a retaining ring and, in one aspect, such a ring is threaded in place with left hand thread. This sacrificial element may be any desired length and extending up into the barrel as desired. The sacrificial element 34 as shown is, in certain aspects, about ten to twelve inches long. The sacrificial element may be made of any suitable material, e.g., but not limited to, fiberglass, steel, soft steel, stainless steel, brass, bronze, 4140 steel with hardened nitride surface, composite, phenolic, phenolic with a metal sleeve on the outside diameter, thermoplastic, zinc, zinc alloy, aluminum, aluminum alloy, plastic, known bearing material(s), and/or a combination thereof. The sacrificial element 34 inhibits and/or prevents milling of the interior of the barrel where the element is located. The barrel 33 has an upper end with ACME threads and is thereby threadedly connected to a similarly threaded lower end of a slip body 35. These two members are also keyed together with two keys 36 (one shown) spaced apart 180° around the barrel/slip body interface. Each key 36 is in a compound slot 38 that extends from the slip body 35 to the barrel 33 and is held in place with a key screw 37 extending through the key 36 and screwed into the slip body 35.

The slip body 35 has grooves 38 formed in an interior surface thereof in which are movably and releasably held bolts 81 (to be described below) which are secured to the mill apparatus 20 and provide a selective clutching action between the mill apparatus 20 and the slip body 35. Holes 39 through the slip body 35 provide for fluid flow and washout around slips 56 (described below).

The slip body 35 has an upper end threadedly connected to a crossover adapter 41. In one aspect an ACME joint is used with ACME threads on both members and one or more set screws 42 also hold the two members together. The crossover adapter 41 is similarly connected to an upper member 43.

A cone mandrel 40 is initially releasably pinned to the slip body 35 with shear pins 43. As described below, upon shearing of the shear pins 43 (e.g. at about 8000 to 10000 pounds of force), the cone mandrel 40 is freed to move down so that a lowered tapered end 44 thereof contacts the slips 56 and is forcibly wedged and held therebetween. Bow springs 58 urge the slips 56 inwardly (for running and for retrieving) until the cone mandrel 40 moves them out through slots in the slip body to contact the casing (not shown). The bow springs 58 may be retained in grooves 56*a* of the slips 56. As the cone mandrel 40 forces the slips 56 outwardly through slots 35*a* in the slip body to engage the casing for setting, the bow springs 58 are compressed within the grooves 56*a*. When the cone mandrel is retracted to release the slips, the spring force of the bow springs 58 returns the bow springs 58 to their original position forcing the slips 56 away from the casing and back through the slots 35*a* of the slip body 35, in one aspect sufficiently far therein that any teeth or pointed part of the slips 56 are fully within the slip body 35 so that retrieval of the cone mandrel is not impeded. In the particular embodiment in which slips with a diamond point tooth profile are used, such slips provide longitudinal and rotational resistance to various mechanical loads and they also provide a low stress set condition and slip teeth-casing interface with, in one aspect, minimal casing wall deformation. Bolts 59 hold the springs 58 to the slips 56. The adjusting bolts 59 are adjustable through the holes 55. The slips may have a known serrated, toothed and/or diamond point profile to enhance engagement with the casing wall. In one aspect, the system is dimensioned so that the mill starts milling a whipstock lug immediately upon exit of the bolts 81 from the grooves 38. In other aspects there is some downward free travel from the grooves 38 prior to the commencement of milling and, in one aspect, at least one to two inches of free travel, in the grooves 38 of bolts 81.

The cone mandrel 40 has holes 45 therethrough through which extend shear pins 46 that shearingly hold an internal mandrel 21 of the mill apparatus 20. The fluid pathways 46 are provided through the upper end of the cone mandrel 40.

Figure 2A:
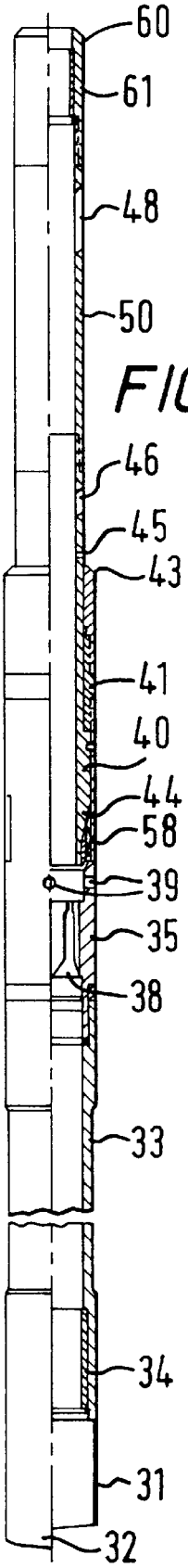
FIG. 2A is a side view partially in cross-section of various outside members of the system of FIG. 1A.
Figure 2B:
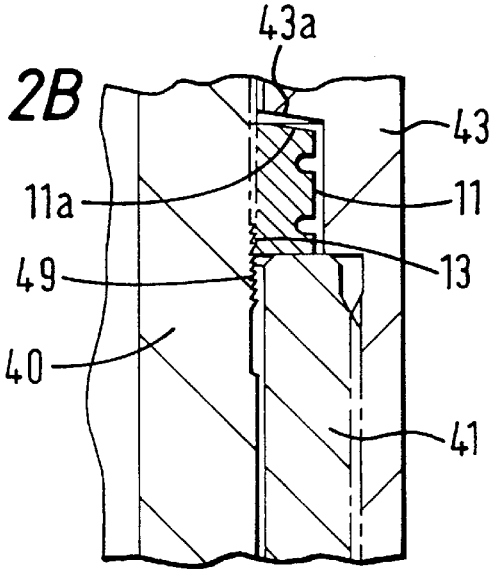
FIGS. 2B, 2C, 2D and 2E show enlargements of parts of the members in FIG. 2A.
Figure 2C:
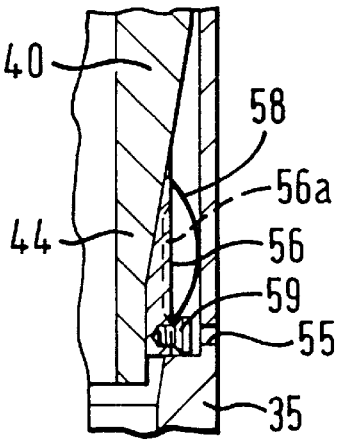
Figure 2D:
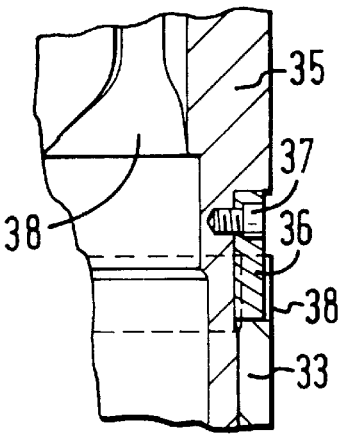
Figure 2E:
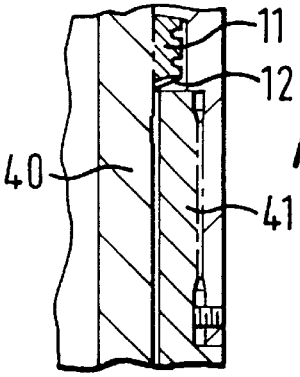

After the cone mandrel 40 moves down, it is maintained in its new down position with a locking ratchet mechanism that includes a ratchet member 11 which is a circular ring with ratchet teeth 13 disposed between an exterior ratchet-toothed surface 49 of the cone mandrel 40, an interior surface of the upper member 43, and a top of the crossover adapter 41. A spring 12 urges the ratchet member 11 upward toward the cone mandrel 40. The springs, e.g. but not limited to known commercially available wavesprings, maintain the ratchet ring 11 energized against the cone mandrel and minimize backlash ("backlash" is a tendency of a ratchet teeth on one ratchet member to disengagingly move across corresponding ratchet teeth on another ratchet member) during release of the force used to set the slips. In one aspect the ratchet teeth on both members are fashioned to shear off in response to a known force (e.g. in one aspect a force of about 40,000 pounds of force or the ring 11 is designed to shear at about 40,000 pounds) so that the cone mandrel 40 and mill 70 may be removed from the wellbore, as described below. In the embodiment shown in FIG. 2E, the ratchet member 11 has a tapered top surface 11*a* that co-acts with a corresponding tapered surface 43*a* so that upon contact of the surfaces the ratchet member 11 is forced toward the cone mandrel (i.e. there is a radial force component).

The cone mandrel 40 has an upper end joined to an adapter housing 50. In one aspect ACME threads and an ACME joint are used to hold these two members together, including set screws 47. The adapter housing 50 has fluid pathways 48 permitting fluid to flow from outside the adapter housing to its interior and vice-versa; in one aspect, for inside-outside flow providing a circulation path down through the center of the system and through the mill moving back up in an annular part of the system and out the fluid pathways 46, 48.

A sleeve bearing 61 is secured in a bearing cap 60 which is joined to the adapter housing 50, e.g. with an ACME joint. The bearing sleeve is made of any suitable bearing material, e.g., but not limited to those materials listed above for the element 34. The sacrificial element and bearing sleeve may be made of metal and/or hardfacing material and/or have applied thereto any known hardfacing material.

The mill apparatus 20 includes a mill 70 with a mill body 71 having a flow bore 72 therethrough from top to bottom with a plurality (two shown) of lower exit ports 73 in communication with the flow bore 72 and the space below the mill body 71. The mill body 71 (shown undressed in FIG. 1A and dressed in FIG. 3A) may be dressed with any suitable drilling, cutting and/or milling inserts and, in one aspect, with any known milling and/or drilling matrix material in any known combination, pattern, array, or arrangement. Any known blades and/or cutters may be used on the mill 70 dressed with any known inserts and/or matrix material in any known manner. FIGS. 3A–3G, described below, present one of many possible particular embodiments of a mill 70.

The mill 70 is connected with screws 74 at its top to a clutch adapter 80 which has a fluid flow bore 82 therethrough from top to bottom and a plurality of bolts 81 disposed therethrough with heads 83 projecting outwardly therefrom into the grooves 38 of the slip body 35. The clutch mechanism (bolts 81; grooves 38) prevents undesirable pre-loading of shear pins in the system above the clutch adapter.

Figure 10:
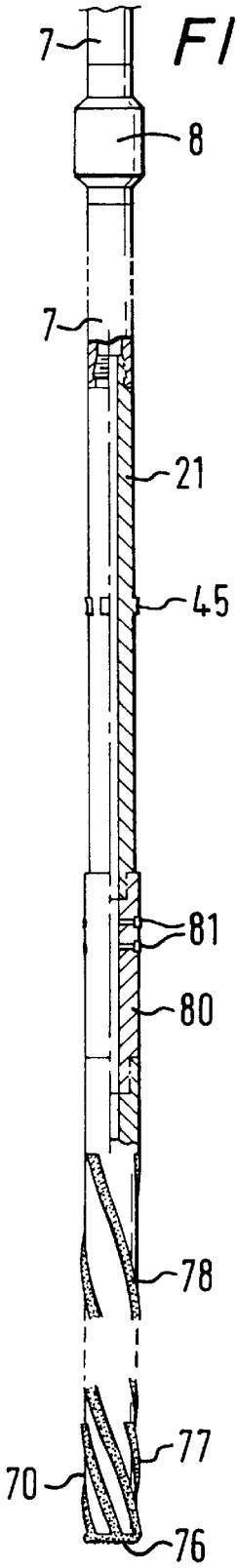
FIG. 10 is a side view partially in cross-section of a system according to the present invention.

An upper end of the clutch adapter 80 is threadedly connected to the inner mandrel 21's lower end and pins 84 secure the two member together (e.g. with an ACME joint and set screws). A fluid bore 22 extends through the inner mandrel 21 and it has a top threaded end for threadedly mating with a hollow drill string 25 that extends to earth surface in a wellbore in which the system 10 is located. The drill string 25 may include one, two, three or more drill collars, the lowest of which is connected to the inner mandrel 21. A no-go sub 8 (see FIG. 10) may be used with drill collar(s) 7. In one aspect the drill collar or collars may be known spiral drill collars. In one particular embodiment, one spiral drill collar is used below a no-go sub and the one spiral drill collar is connected to the mandrel 21. A properly positioned no-go sub limits the lowest extent of the mill's downward movement and, with proper dimensioning is used to insure that the mill does not mill an item, e.g. an orienting device, e.g. an orienting nipple, disposed below a whipstock. Also, such dimensioning can be used so that a mill can move downwardly sufficiently to mill an item, e.g. a plug, below a whipstock. Thus with the use of a no-go sub and proper dimensioning of the system components a typical spacer element and/or empty space previously used between (a) the lower end of a whipstock and/or a lower end of a whipstock anchor, packer, or anchor packer and (b) an orienting device, e.g. but not limited to an orienting lug or nipple of a packer, may be eliminated with the accurate, and precise, downward travel location and limit of the mill is known by the operator. This also inhibits or prevents unwanted and injurious milling of the orienting device etc.

Figure 3A:
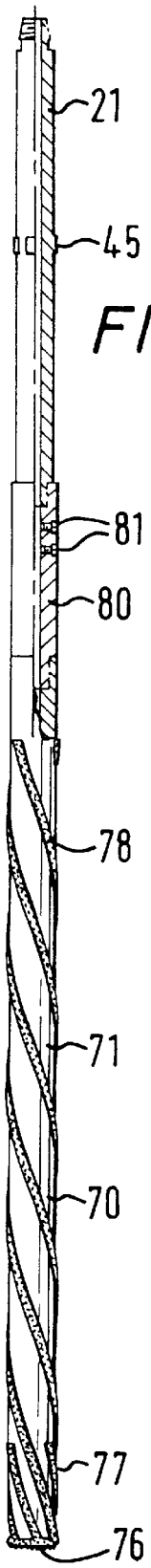
FIG. 3A is a side view, partially in cross-section, of a milling apparatus of the system of FIG. 1A.
Figure 3B:
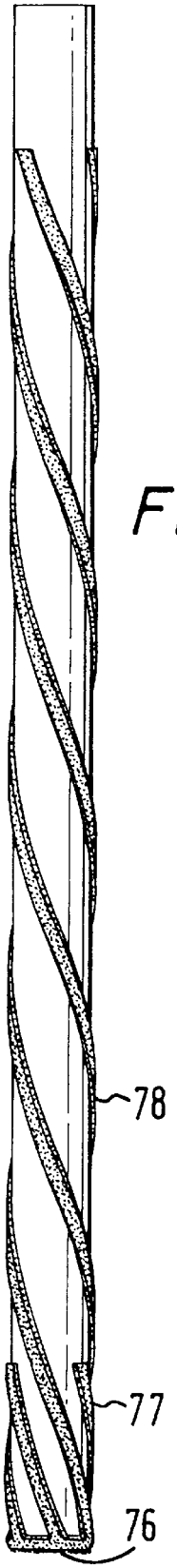
FIG. 3B is a side view that shows a mill of the milling apparatus of FIG. 3A.
Figure 3C:
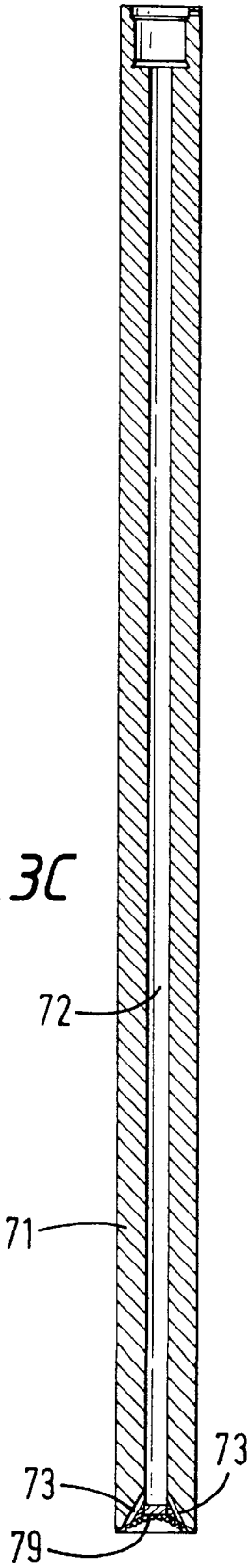
FIG. 3C is a cross-section view of the mill of FIG. 3B.
Figure 4A:
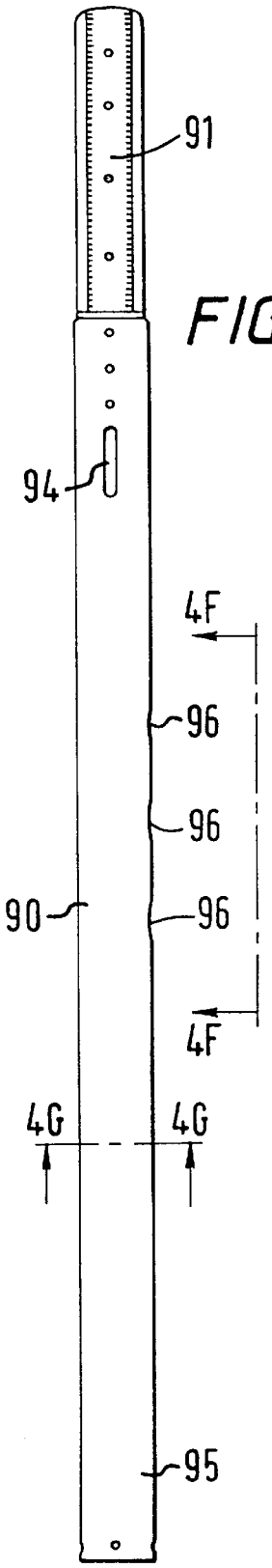
FIG. 4A is a rear view of a whipstock according to the present invention.
Figure 4B:
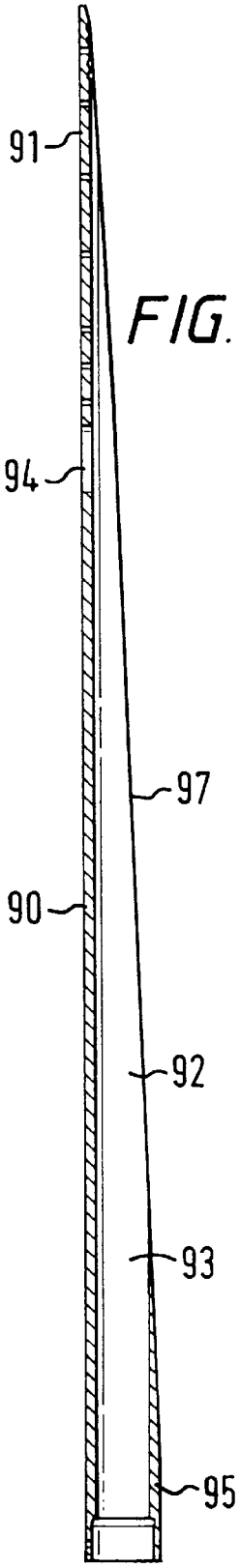
FIG. 4B is a side cross-section view of the whipstock of FIG. 4A.
Figure 4C:
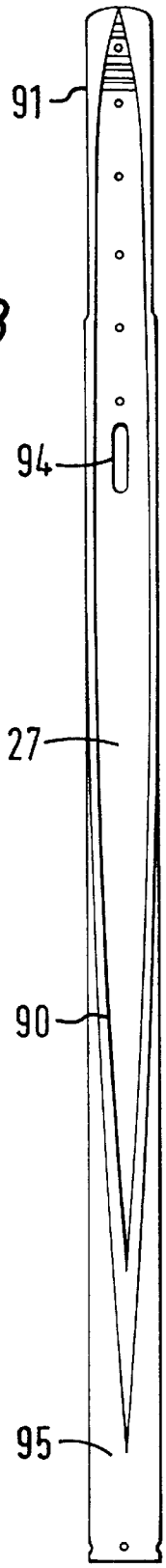
FIG. 4C is a front view of the whipstock of FIG. 4A.

As shown in FIGS. 3A–3G, in one aspect the mill 70 has matrix milling material 76 applied to the bottom of the mill body 71 and/or within the end of the bore (numeral 79), matrix milling material 77 in spirals applied at the end of the mill body 71, and matrix milling material 78 in spirals up the body 71. Any suitable matrix milling material, e.g. but not limited to commercially available KUTRITE™ material may be used, with or without additional inserts. Alternatively, the mill body may have dressed or undressed blades instead of the material 76 and/or the material 78. FIG. 3E shows the body 71 prior to matrix milling material application FIGS. 4A–4G show a whipstock 90 according to the present invention with a top 91, an inner channel 92 filled with filler 93, a retrieval slot 94, a concave 97, and a lower end 95. FIG. 4D presents various levels of the cross-section views shown in FIG. 4E. FIG. 4F is a side view along line 4F—4F of FIG. 4A and shows handling holes 96.

Figure 4E:
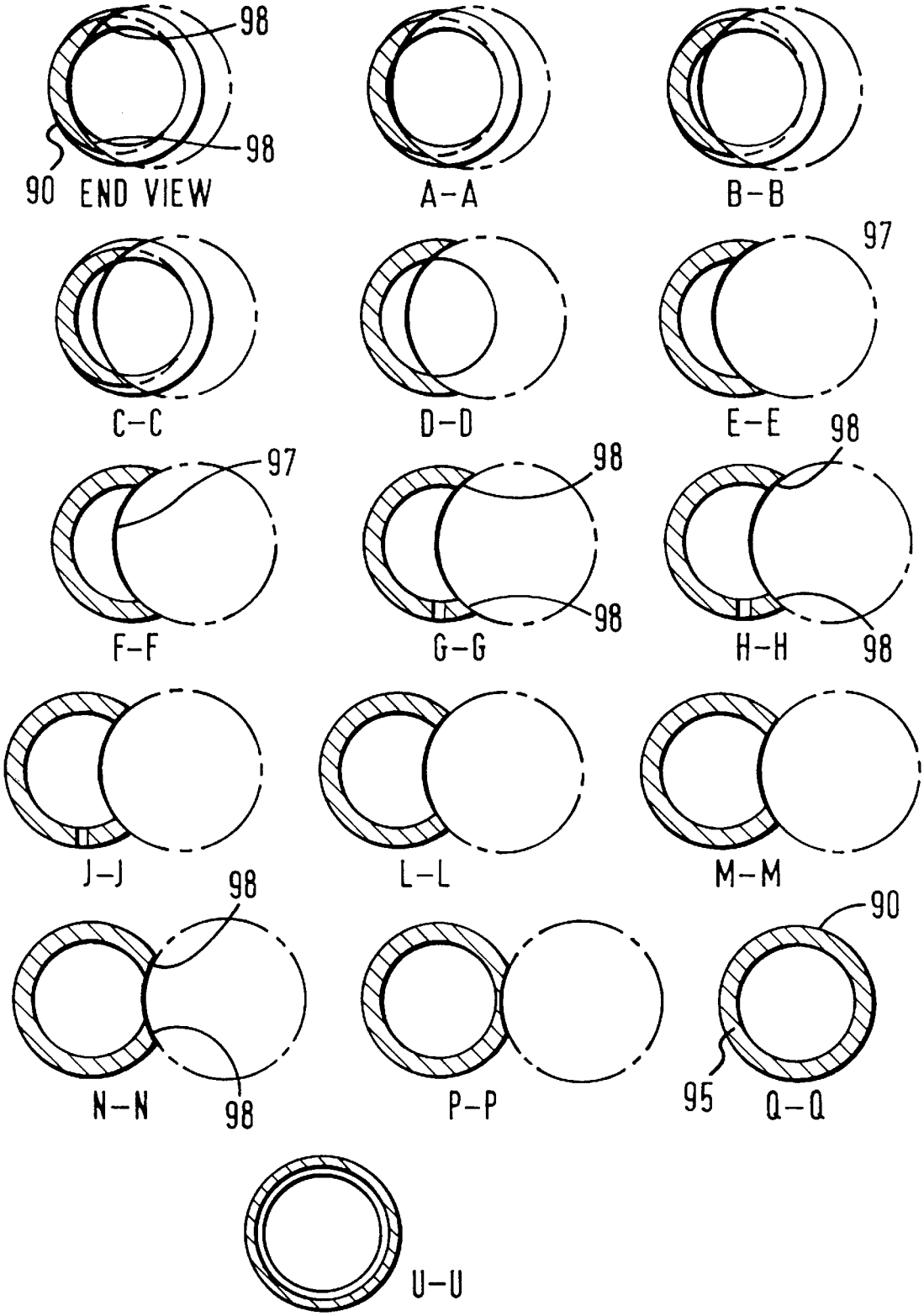
FIG. 4D is like FIG. 4B with a series of cross-sections indicated which are shown in FIG. 4E.
FIG. 4F is a side view along line 4F—4F of FIG. 4A.
FIG. 4G is a cross-section view along line 4G—4G of FIG. 4F.

FIG. 4E shows the edges of rails 98 and indicates how they approach each other from top to bottom of the whipstock.

FIGS. 5A–5E show the whipstock 90 with attached lug 99, lower lug 99*a,* and slots 99*b* for torque-clutch connection to certain known packers. FIG. 5C shows the various cross-section views indicated by lines A—A etc. in FIG. 5A.

Operation

In one particular method according to the present invention, a system 10 is connected at the end of a drill string (like the drill string 25, FIG. 1A1) and is lowered into a wellbore in which is positioned a whipstock. In one aspect the whipstock is hollow and an interior hollow space thereof is filled with a solid filler material (and may be any suitable whipstock disclosed herein or by reference). The system 10 is moved down to contact the whipstock.

The system 10 is then rotated to facilitate emplacement of the lower shoe portion 31 between the exterior of the top of the whipstock and the interior surface of the wellbore. The lower shoe portion 31 is wedged between these two surfaces so that the system 10 is anchored and stabilized in place on top of and with respect to the whipstock.

The rotation of the system 10 can produce torque on the system's inner components. Any torque load thus imposed on the system 10 is transmitted via the bolts 81 in the grooves 38 to the slip body 35 and thus to the outer members of the system 10, thereby isolating components above the bolts 81, particularly the cone mandrel from such a load to isolate the load from pins 46 while rotating down onto a whipstock, thereby inhibiting or preventing premature setting of the slips 56.

Initial setting of the cone mandrel 40 within outer components of the system 10 (slip body 35, crossover adapter 41) and, thereby, of the mill 70 which is interconnected with the cone mandrel 40 via the clutch adapter 80 and inner mandrel 21, is achieved by shearing of the shear pins 43 by downward movement of the drill string 25. The cone mandrel 40 is thus freed and can move down a distance d (see FIG. 1A) within the slip body 35 (along with everything connected below the cone mandrel) to set the slips 56 against the casing. During this downward movement, the tapered portion 44 of the cone mandrel 40 wedges between the slips 56.

The mill 70 is then freed for downward movement and milling by further downward movement of the drill string 25, thereby shearing the shear pins 46. In one particular aspect the shear pins 43 are set to shear at a force of about 5,000 to 10,000 pounds and the shear pins 46 at a force of about 20,000 pounds or more. The bolts 81 move out of the grooves 38 as the clutch adapter 80 is moved downwardly with respect to the slip body 35, thus freeing the mill 70 for rotation by the drill string 25.

The drill string 25 is then lowered and rotated to rotate the mill to mill out a pathway through the whipstock. The barrel 33 guides the mill 70 as the mill 70 moves downwardly. Eventually the lower part of the mill 70 is received at some point between the rails of the whipstock's concave and is thus guided by the concave. Thus undesirable lateral movement of the mill 70 is inhibited and/or prevented by the mill guide barrel 33, and by the lower part of the concave once the mill has progressed downwardly to a point at which the concave receives the lower part of the mill 70. In one aspect the concave will begin to receive and hold the mill at about three feet down the concave; and, in other aspects, at about five to six feet down the concave. In certain preferred embodiments the system components are fashioned, configured, and dimensioned so that at least a portion of the mill is stabilizingly located between the concave rails before the mill exits completely from the lower shoe portion of the mill guide barrel.

The mill 70 is configured and dimensioned, in one aspect, to be sufficiently long to mill through the whipstock while part thereof is still within the lower part of the mill guide barrel 33, and in one aspect, in the shoe portion. If desired, the mill 70 is moved further downwardly to mill away an anchor apparatus that anchors the whipstock in the wellbore. In another aspect the mill 70 progresses further downward to mill out a plug set below the whipstock anchor apparatus to seal off the wellbore below the whipstock. Alternatively, the system 10 can be removed and another mill apparatus is introduced on a drill string into the wellbore to mill out the whipstock anchor apparatus and/or the wellbore plug.

During milling, milled cuttings and debris are circulated upward through the system 10 and to the earth surface with circulating fluid pumped down the drill string 25, down the center of the system 10, and out through the lower exit ports 73. The fluid with cuttings and debris therein then flows up between the exterior of the mill 70 and the interior of the barrel 33, between the clutch adapter 80's exterior and slip body 35's interior, with some flow out through the holes 39 and up between the inner mandrel 21's exterior and the interior of the cone mandrel 40, and both out the fluid pathways 46 and 48 (into the annulus between the exterior of the system 10 and wellbore's interior) and up between the drill string 25's exterior and the system 10 interior. Once past the system 10, the fluid with cuttings and debris entrained therein flows up the annulus between the drill string 25 and the wellbore.

When milling ceases, an upward pull on the drill string moves the mill 70 and clutch adapter 80 up to a point at which the top of the clutch adapter 80 contacts the bottom of the cone mandrel 40. Further pulling with sufficient force overcomes the holding ratchet ring 11, shearing the teeth and/or breaking the ring 11, and as the cone mandrel 40 then moves up the slips 56 are disengaged. In one aspect a pull of about 40000 pounds (or more) shears the ring 11. Also as the clutch adapter 80 moves up, the bolts 81 re-engage with the grooves 38 of the slip body 35. Milling and system retrieval can thus be done in a single trip into the wellbore.

In one aspect the mill body 71 is about 8 feet long and there are six lower milling material spirals 77, three of which extend upwardly to a level about 12 inches from the mill's bottom and three of which continue upwardly as milling material spirals 78 to a level about seven feet from the mill bottom. In one aspect part of the front end face is recessed from the mill bottom in a concave shape and also has two dressed ramps or ramped surfaces 75 formed with matrix milling material diverging in opposite directions for aggressive cutting of metal (e.g. brass components) and other cast components in the whipstock (e.g. one ramp 75 as in FIG. 3H) including any valve and/or valve seat therein. The concave surface at the mill bottom assists in producing a profile with a corresponding shape in filler within the whipstock so that downward mill motion is facilitated and motion out from the concave is inhibited.

In cases in which multiple trips are employed to complete milling operations, any suitable known mill system with any known mill and/or mills may be used to finish milling. In one aspect an undersized ("undersized" is less than full gauge) nose mill (in one aspect a small nose mill that will move down through the whipstock's rails for milling of a plug below the whipstock) is used in tandem with one, two or more watermelon mills thereabove.

Figure 6A:
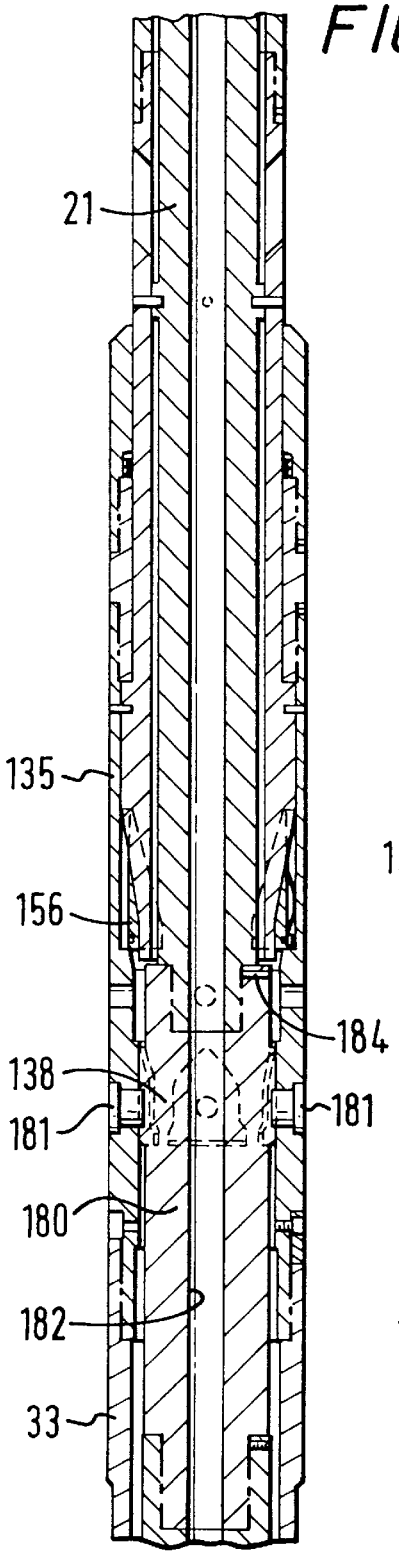
FIG. 6A is a side cross-section view of an alternative version of a system like that of FIG. 1A.
Figure 6E:
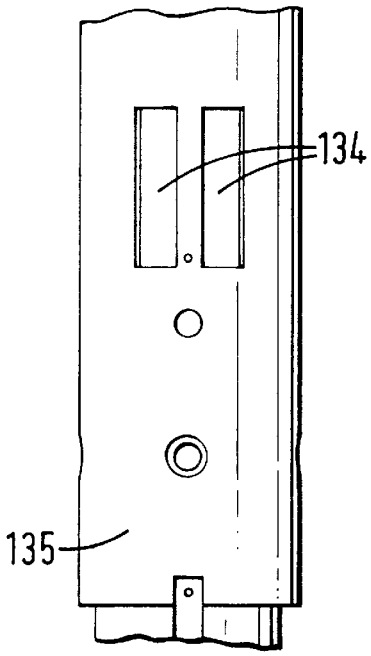
FIG. 6E is a side view of part of the slip body of FIG. 6B.
Figure 6B:
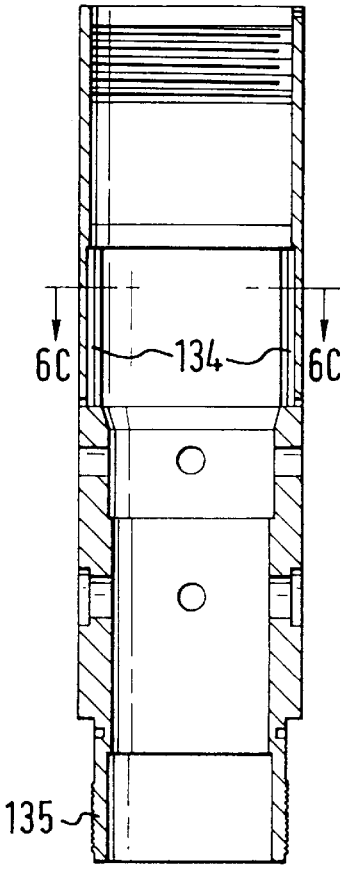
FIGS. 6B and 6F are views of parts of the system of FIG. 6A.
Figure 6C:
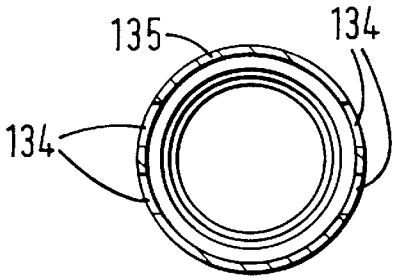
FIG. 6C is a cross-section view along line 6C—6C of FIG. 6B.
Figure 6D:
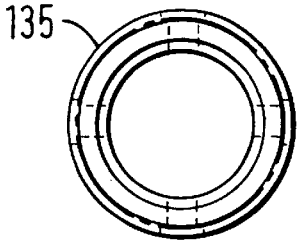
FIG. 6D is a top end view of the slip body of FIG. 6B.
Figure 6F:
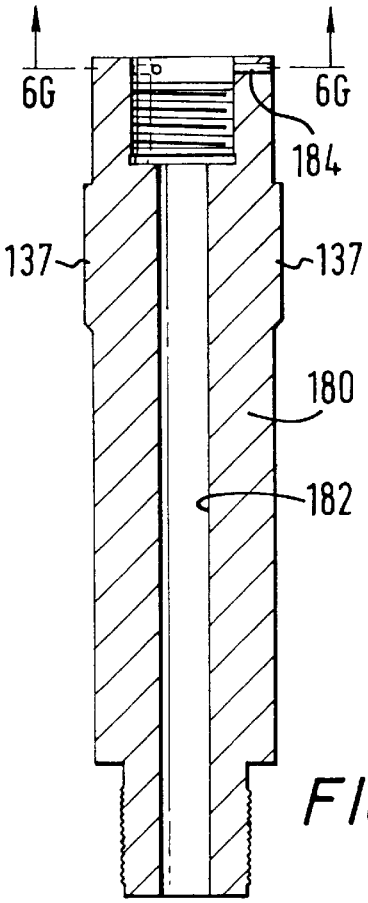
Figure 6H:
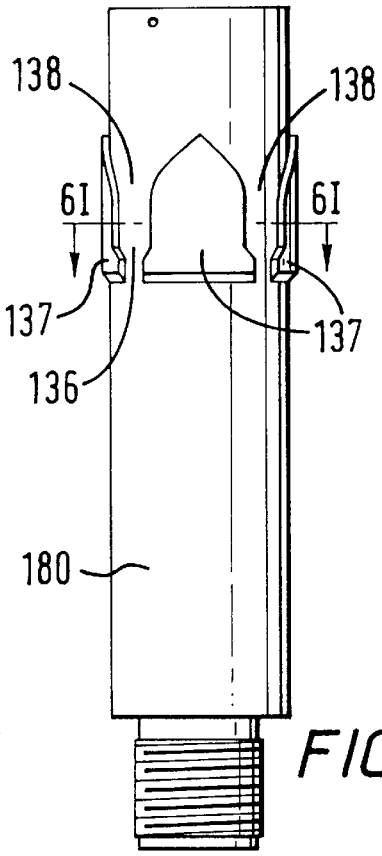
FIG. 6H is a side view of the clutch adapter of FIG. 6F (and of FIG. 6A).
Figure 6G:
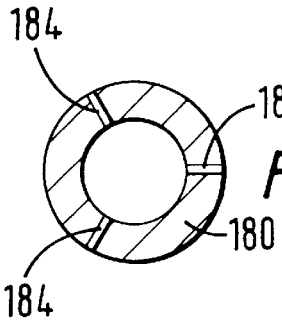
FIG. 6G is a cross-section view along line 6G—6G of the clutch adapter of FIG. 6F.
Figure 6I:
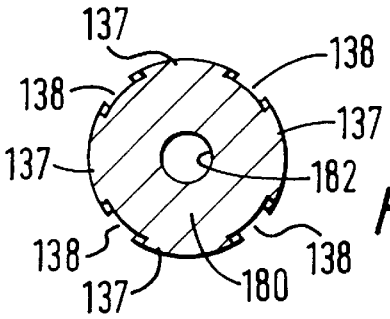
FIG. 6I is a cross-section view along line 6I—6I of FIG. 6H.
Figure 6J:
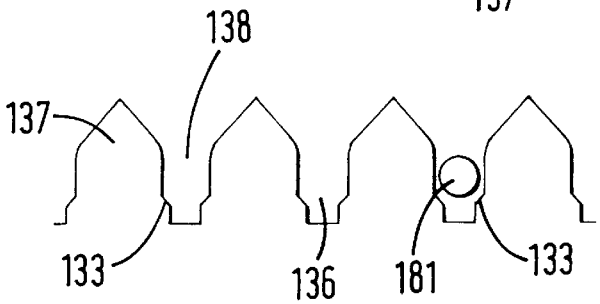
FIG. 6J is a side "unwrapped" view of part of the clutch adapter as shown in FIG. 6H.

FIGS. 6A–6F present some alternative components for the system 10. FIG. 6A shows a clutch adapter 180 with a flow bore 182 (like the bore 82) and grooves 138 defined by members 137 formed thereon. Pins 181 in a slip body 135 project into the grooves 138 when the parts are positioned as shown in FIG. 6A. Thus, in this embodiment, until the clutch adapter 180 moves down away from the pins 181, the mill and other interconnected parts are held against rotation. Also, upon completion of milling, when the inner mandrel 21 is retracted, the clutch adapter 180 moves back up so that the pins 181 move into the grooves 138 (which have pointed tops and partially tapered sides for pin receipt and for facilitating pin movement into holding areas 136) thereby providing automatic re-clutching of the system. The slips 156 (like the slips 56) move in and out of slots 134 in the slip body 135 (like the slip body 35). Thus the shoulders 133 are an additional pick up surface for pick up and retrieval of the system. Also, in the event a washover shoe is used to mill down around the inner mandrel 21 and therebelow and past the slips, the washover shoe can mill off the projecting portions of the pins 181. Pins 184 are like the pins 84. Other parts of the clutch adapter 180 are like those of the adapter 80 and parts of the slip body 135 are like those of the slip body 35.

FIGS. 7A–7C disclose a system 150 according to the present invention which includes a mill guide 152 having a top 154, a bottom 156, a bore 158 therethrough from top to bottom, and a portion 151 of reduced wall thickness. A whipstock 160 has a top 162, a bottom 164, an optional filler 165 in a bore 166, and a concave surface 168. The whipstock 160 may be any suitable known whipstock or diverter used with mills, drills, and/or mill-drills. In the hollow embodiment, the whipstock may contain any known filler and/or flow control apparatus. Any suitable known anchor, setting mechanism, anchor-packer, or packer is indicated by the item 159. The item 159 may also include suitable orienting device(s) and/or mechanism(s) (alternatively such orienting apparatus may be separate from the item 159 and, in one aspect disposed thereabove). The portion 151 of reduced thickness is positionable, as shown, between an inner wall of an earth wellbore 148 casing 167 and an outer surface 163 of the top 162 of the whipstock 160. Upon lowering, the mill guide 152 may be rotated so that the portion 151 is correctly positioned for this emplacement. In this position, there is stabilizing contact of the mill guide 152 with the whipstock. In one aspect, as shown, the bottom 156 of the mill guide 152 extends down to substantially block off a lateral wellbore 149 that extends from the main wellbore 148. Thus the undesirable flow of fluid and/or material (e.g. but not limited to milling cuttings) into the lateral wellbore 149 is inhibited or prevented and the circulation of them up from the location of the whipstock is facilitated during milling and/or during fluid pumping.

The mill guide 152 has a tapered surface 157 that corresponds substantially to the taper of the whipstock's concave 168 thereby further enhancing the effect of preventing flow into the lateral wellbore 149. The features of the mill guide 150 (any, all, or any combination thereof) may, in accordance with the present invention, be incorporated into any mill guide or guide shoe portion disclosed herein or incorporated herein by reference.

FIG. 7D shows an alternative aspect of the mill guide 152 with a seal member 165 around a surface 167 (like the surface 157, FIG. 7C). All or part of the seal member 165 contacts a whipstock's concave for further preventing flow into a lateral wellbore. The seal member 165 may be any suitable sealing material, gasket, gasketing material, and/or seal member. A groove (not shown) may be provided in the surface 167 for receiving and holding the seal member 165 (e.g. but not limited to an O-ring groove and an O-ring) and/or adhesive may be used to hold the seal member in place. FIG. 7E shows a mill guide as in FIG. 7A, but with a seal member or gasket 163 that initially projects (from a surface 161 (like the surface 167). In one aspect the seal member 163 is any known sealing material, gasket material, polyethylene, plastic, or suitable foam material.

Figure 8:
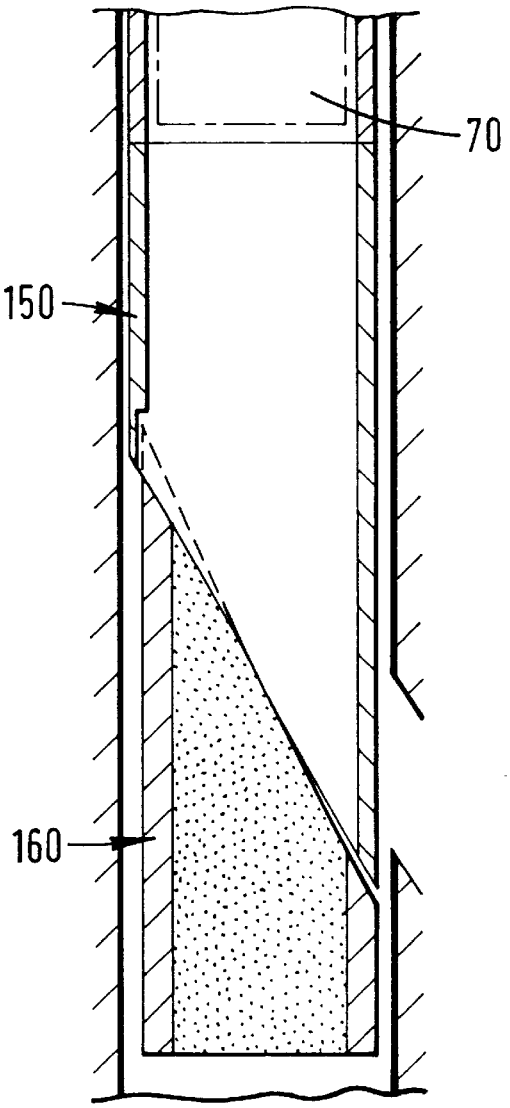
FIG. 8 shows a milling system according to the present invention.

FIG. 8 illustrates use of a system 150 with the system of FIG. 1A with the mill guide 152 used as the shoe portion 31 of the system 10 and for guiding the mill 70 (shown schematically in dotted lines in FIG. 8).

Figure 9:
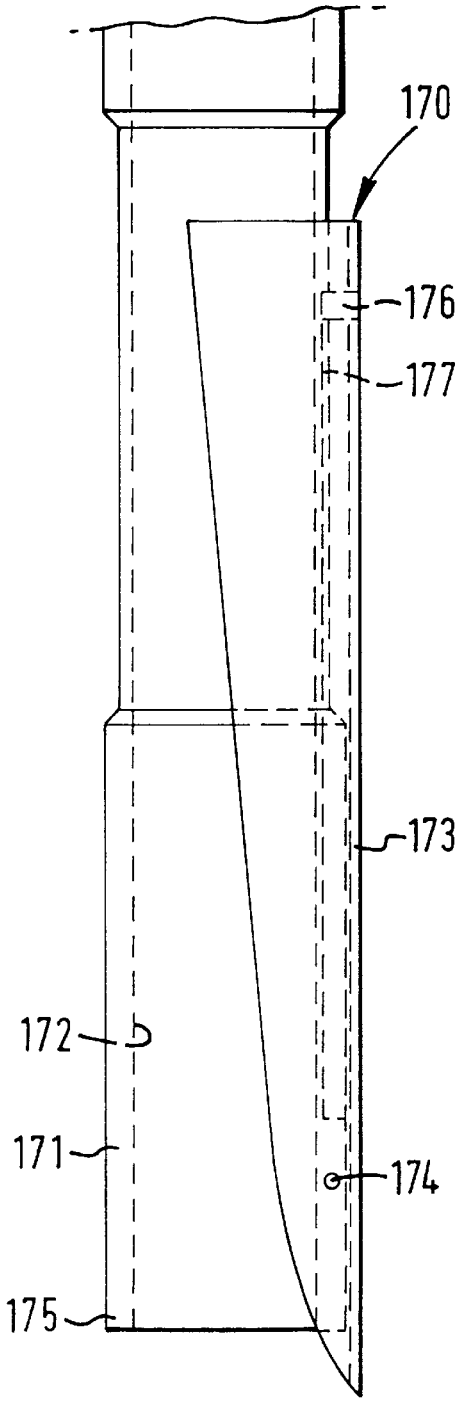
FIG. 9 shows a side view of an alternative mill guide or guide shoe according to the present invention.

FIG. 9 shows an alternative embodiment for a guide shoe, a guide shoe 170 for the guide shoe portion 31 of the system 10. The guide shoe 170 has a hollow body 171 with a bore 172 therethrough and an extension sleeve 173 shear-pinned to the body 171 with one or more shear pins 174. By shearing the shear pins 174 (e.g. with an appropriate downward force; e.g. after the system is set on an anchor-packer) the sleeve 173 is freed to fall down past a bottom end 175 of the body 171. An optional pin 176 through the sleeve 173 projects into a slot 177 in the body 171 and guides downward movement of the sleeve 173. The sleeve 173, therefore, may be extended to close off part or all of a lateral wellbore adjacent the guide shoe and/or to contact a whipstock for further stabilization of the guide shoe. The sleeve may be any desired length. Any suitable sealing material may be applied to one or both sides of the sleeve 173 and/or to a tapered portion 179 that mates with a tapered part of a whipstock's concave. The tapered portion 179 may be any desired shape and/or length, e.g. in one aspect to correspond to a concave or part thereof.

Figure 11A:
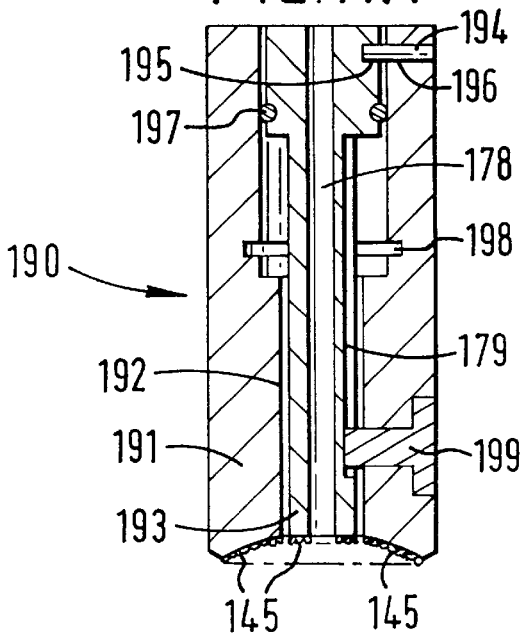
FIGS. 11A and 11B are side views in cross-section of a mill according to the present invention.
Figure 11B:
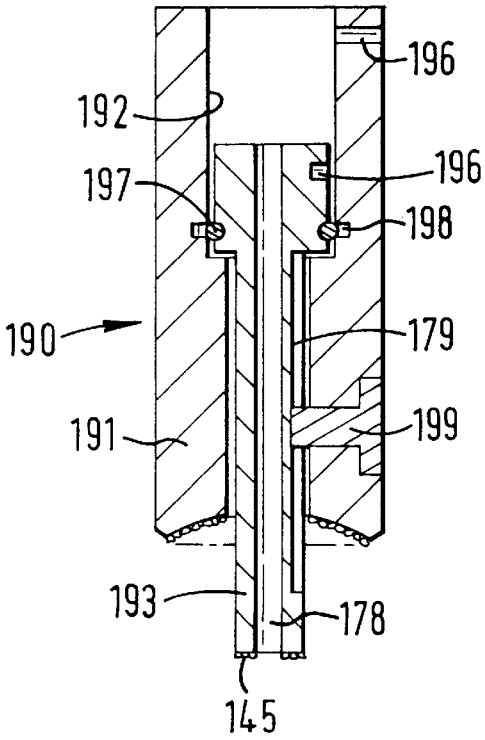
Figure 11C:
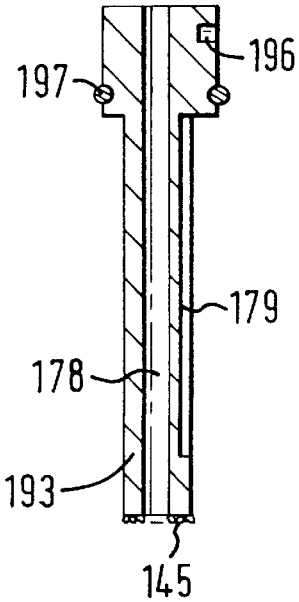
FIG. 11C shows part of the mill of FIG. 11A.

FIGS. 11A–11C show a mill 190 according to the present invention which can be sued with the system 10. The mill 190 has a body 191 and a channel 192 therethrough in which is movably and releasably disposed a pilot mill 193 that is initially held in place with a shear pin 194 that extends through a hole 195 in the body 911 and into a hole 196 in the pilot mill 193. A fluid circulation bore 178 extends through the pilot mill 193.

Upon shearing of the shear pin 194 (e.g. with increased pumped fluid pressure) the pilot mill 193 is freed and moves down to the position shown in FIG. 11B. A snap ring 197 snaps into a recess 198 to hold the pilot mill in place and a pin 199 through the body 191 rides in a slot 179 in the pilot mill 193 to transmit torque so the pilot mill 193 is rotatable with the mill 190. Any suitable milling material 145 is used on the end of the mill 190 and pilot mill 193 (e.g. known material and/or inserts).

By using the pilot mill 193, an operator can mill down through a hollow whipstock and into and through a plug beneath the whipstock without the danger of the full gauge full mill milling down and through the plug and into an anchor-packer and/or orienting device that are, preferably, not to be milled at this point. The pilot mill can open a path through the whipstock plug (e.g. a permanent plug) and give the operator a positive indication that this has occurred and of the location of the mill with respect to a lower anchor-packer and/or orienting device, without milling of or damage to the lower item(s).

Figure 12A:
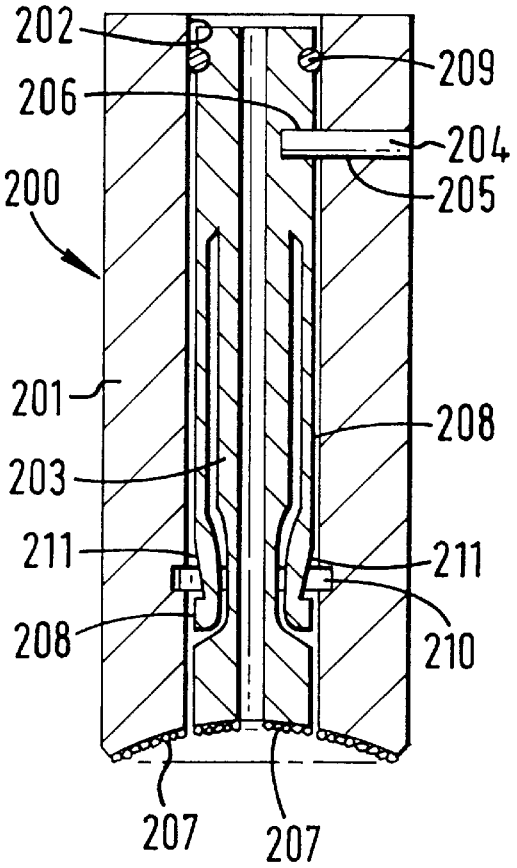
FIGS. 12A and 12B are side views in cross-section of a mill according to the present invention.
Figure 12B:
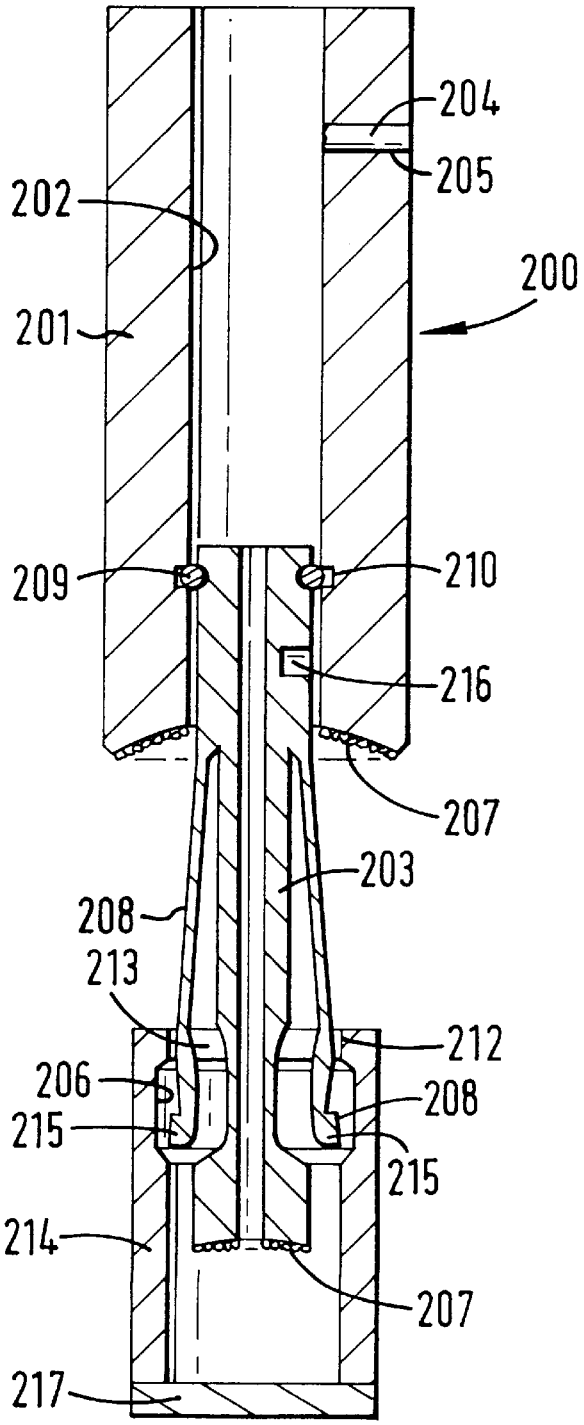

FIGS. 12A and 12B disclose a mill 200 according to the present invention which, in one aspect, may be used as the mill 70 of the system 10. The mill 200 has a body 201 with a channel 202 therethrough in which is movably and releasably disposed a pilot mill-spear 203 which is initially releasably held in place by a shear pin 204 extending through a hole 205 in the body 201 and into a recess 206 in the pilot mill-spear 203. Milling material 207 is like the material 145, FIG. 11A.

Outwardly expandable collets 208 are secured to or formed integrally of the pilot mill-spear 203 and are initially prevented from outward movement by the wall of the channel 202.

Upon flowing fluid at sufficient pressure through the channel 202, the shear pin 204 shears and the pilot mill-spear 203 moves down in the channel 202. As shown in FIG. 12B, a snap ring 209 partially moves into a recess 210 to hold the pilot mill-spear 203 in place. Tapered portions 211 of the collets 208 are movable on and past an upper surface 212 of an opening 213 of a fishing neck 214 and then lower collet ends 215 move into and are releasably held in recesses 216 of the fishing neck 214. Item 217 indicates any apparatus or item to which the fishing neck 214 is attachable or securable e.g., but not limited to an anchor, packer, anchor-packer, and/or orienting device disposed in a wellbore beneath a whipstock. As with the mill 190, the mill 200 provides an indication to an operator of mill position when the collets move into and are held in the recess 216. The collet engagement also stops downward movement of the mill and prevents milling of the item(s) 217. A pin 199-slot 179 structure (see FIG. 11A) may be used with the mill 200.

Figure 13A:
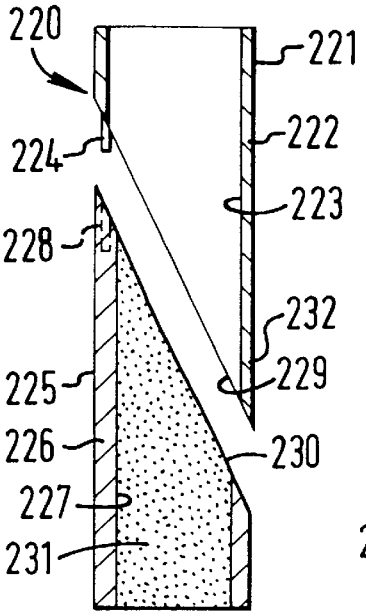
FIGS. 13A–13F are side views in cross-section of a guide-whipstock systems according to the present invention.

FIG. 13A shows a guide-whipstock system 220 with a mill guide 221 (which can serve as the guide shoe portion 31 for the system 10) having a body 222 with a bore 223 therethrough and a finger 224 projecting therefrom. A whipstock or diverter 225 has a body 226 with a bore 227 therethrough and a recess 228 sized and disposed for receiving the finger 224 so the mill guide 221 and whipstock 225 are in stabilized contact. In one aspect a surface 229 of the mill guide 221 corresponds in shape to and sealingly contacts at least part of a concave surface 230 of the whipstock 225. The whipstock 225 may be solid or, in one aspect, as shown, may be initially hollow with filler 231 therein filling the bore 227 which is to be milled out. A bottom 232 of the mill guide 221 may, in certain aspects, extend any desired length below a level beginning at a top of the finger 224. In one particular aspect the bottom 232 extends as shown to contact a lower part of the concave surface 230; thus, in one aspect, such a system is useful to substantially close off a lateral bore adjacent the whipstock 225.

Figure 13B:
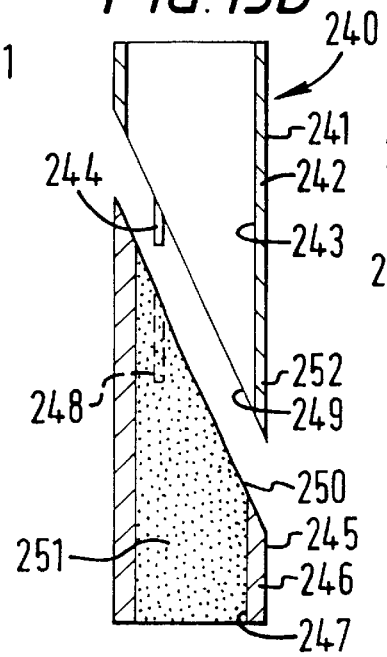

FIG. 13B shows a guide-whipstock system 240 with a mill guide 241 (which can serve as the guide shoe portion 31 for the system 10) having a body 242 with a bore 243 therethrough and a finger 244 projecting from an edge thereof. A whipstock or diverter 245 has a body 246 with a bore 247 therethrough and a recess 248 in filler material 251 sized and disposed for receiving the finger 244 so the mill guide 241 and whipstock 245 are in stabilized contact. In one aspect a surface 249 of the mill guide 241 corresponds in shape to and sealingly contacts at least part of a concave surface 250 of the whipstock 245. The whipstock 245 may be solid or, in one aspect, as shown, may be initially hollow with filler 251 therein which is to be milled out. A bottom 252 of the mill guide 241 may, in certain aspects, extend any desired length below a level beginning at a top of the finger 244. In one particular aspect the bottom 252 extends as shown to contact a lower part of the concave surface 250; thus, in one aspect, such a system is useful to substantially close off a lateral bore adjacent the whipstock 245.

Figure 13C:
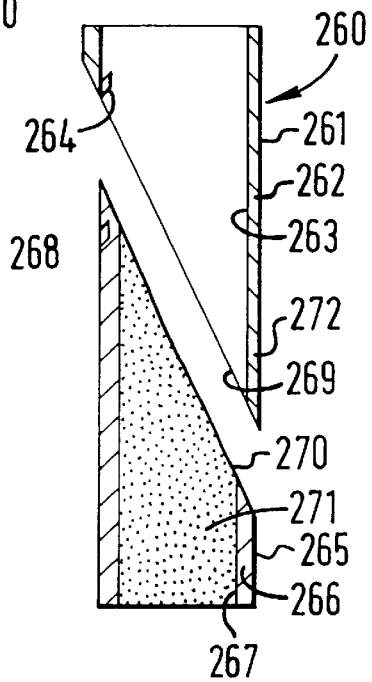

FIG. 13C shows a guide-whipstock system 260 with a mill guide 261 (which can serve as the guide shoe portion 31 for the system 10) having a body 262 with a bore 263 therethrough and a finger 264 projecting therefrom. A whipstock or diverter 265 has a body 266 with a bore 267 therethrough and a recess 268 sized and disposed for receiving the finger 264 so the mill guide 261 and whipstock 265 are in stabilized contact. In one aspect the finger 264 is flexible for ease of entry into the recess 268. In one aspect a surface 269 of the mill guide 261 corresponds in shape to and sealingly contacts at least part of a concave surface 270 of the whipstock 265. The whipstock 265 may be solid or, in one aspect, as shown, may be initially hollow with filler 271 therein which is to be milled out. A bottom 272 of the mill guide 261 may, in certain aspects, extend any desired length below a level beginning at a top of the finger 264. In one particular aspect the bottom 272 extends as shown to contact a lower part of the concave surface 270; thus, in one aspect, such a system is useful to substantially close off a lateral bore adjacent the whipstock 265.

Figure 13D:
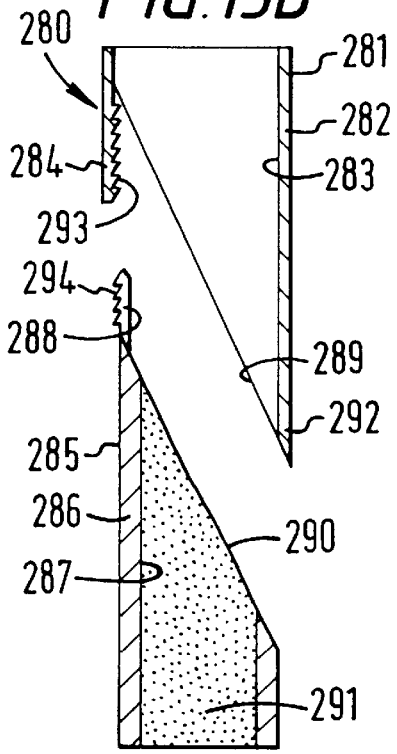

FIG. 13D shows a guide-whipstock system 280 with a mill guide 281 (which can serve as the guide shoe portion 31 for the system 10) having a body 282 with a bore 283 therethrough and a finger 284 projecting therefrom. A whipstock or diverter 285 has a body 286 with a bore 287 therethrough and a top extension 288 sized and disposed for contacting the finger 284 so the mill guide 281 and whipstock 285 are in stabilized contact. In one aspect a surface 289 of the mill guide 281 corresponds in shape to and sealingly contacts at least part of a concave surface 290 of the whipstock 285. The whipstock 285 may be solid or, in one aspect, as shown, may be initially hollow with filler 291 therein which is to be milled out. A bottom 292 of the mill guide 281 may, in certain aspects, extend any desired length below a level beginning at a top of the finger 284. In one particular aspect the bottom 292 extends as shown to contact a lower part of the concave surface 290; thus, in one aspect, such a system is useful to substantially close off a lateral bore adjacent the whipstock 285. Ratchet teeth 293 on the finger 284 are sized and disposed to ratchetingly mate with corresponding teeth 294 on the top extension 288. Such teeth may be shear teeth as described previously above. Any of the fingers 224, 244, 264 and/or recesses 228, 248, 268 may have such teeth.

Figure 13E:
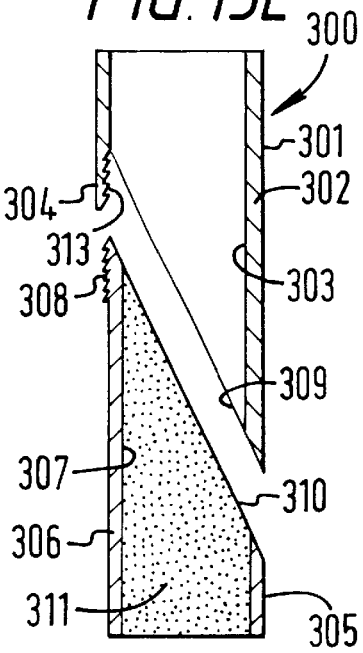

FIG. 13E shows a guide-whipstock system 300 with a mill guide 301 (which can serve as the guide shoe portion 31 for the system 10) having a body 302 with a bore 303 therethrough and a finger 304 projecting therefrom. A whipstock or diverter 305 has a body 306 with a bore 307 therethrough and a ratchet-toothed top portion 308 sized and disposed for co-acting with corresponding ratchet teeth 313 on the finger 304 so the mill guide 301 and whipstock 305 are in stabilized contact. In one aspect a surface 309 of the mill guide 301 corresponds in shape to and sealingly contacts at least part of a concave surface 310 of the whipstock 305. The whipstock 305 may be solid or, in one aspect, as shown, may be initially hollow with filler 311 therein which is to be milled out. A bottom 312 of the mill guide 301 may, in certain aspects, extend any desired length below a level beginning at a top of the finger 304. In one particular aspect the bottom 312 extends as shown to contact a lower part of the concave surface 310; thus, in one aspect, such a system is useful to substantially close off a lateral bore adjacent the whipstock 305.

Figure 13F:
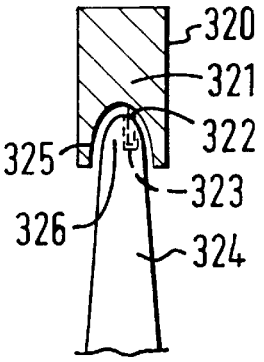

FIG. 13F shows a mill guide 320 (or guide shoe portion for the portion 31 of the system 10) with a body 321 and a stabilizing finger 322 that projects into a recess 323 of a whipstock 324 (shown partially). A notch 325 in the mill guide 320 receives and rests on a top 326 of the whipstock 324. Such a notch may be used on any mill guide or guide shoe portion disclosed herein, with or without a finger, and for any mill guide disclosed herein by reference, as may be any or all of the features and/or structures of any guide disclosed in FIGS. 13A–13E.

Incorporated fully herein in their entirety for all purposes are these U.S. applications co-owned with the present invention: U.S. Ser. No. 08/590,747 filed Jan. 24, 1996 and U.S. Ser. No. 08/683,611 filed Jul. 15, 1996. Submitted herewith as part hereof and appended hereto in their entirety are U.S. applications Ser. Nos. 752,359 filed Nov. 19, 1996 and 08/590,747 filed Jan. 24, 1996.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. Wellbore apparatus comprising a whipstock with a top and a bottom, the whipstock disposed in a wellbore extending down from an earth surface into the earth, the wellbore having an inner surface, a mill guide with a body having an upper end, a lower end, and a channel therethrough from the upper end to the lower end, and a portion of the lower end of the mill guide disposed between and held between the inner surface of the wellbore and an outer surface of the top of the whipstock, the mill guide having a main body having a lower part with a wall thickness, and a shoe at the lower end of the mill guide having a wall member whose thickness is less than the thickness of the lower part of the main body of the mill guide for facilitating emplacement of the mill guide between the wellbore's interior surface and the whipstock.

2. A method for stabilizing a mill guide in a wellbore extending from an earth surface into the earth, the wellbore having an inner surface, the method comprising setting a whipstock at a location in the wellbore, the whipstock having a top and a bottom, moving a mill guide down into the wellbore to contact the whipstock, the mill guide having a body with an upper end, a lower end, and a channel therethrough from the upper end to the lower end, wherein the mill guide has a main body having a lower part with a wall thickness, and a shoe at the lower end of the mill guide having a wall member whose thickness is less than the thickness of the lower part of the main body of the mill guide for facilitating emplacement of the mill guide between the wellbore's interior surface and the whipstock, and positioning the mill guide so that a portion of the lower end of the shoe is received and held between the inner surface of the wellbore and an outer surface of the top of the whipstock.

3. A method for milling within a whipstock set in a wellbore extending from an earth surface down into the earth, the whipstock having a body with a top and a bottom, the whipstock having a concave portion with outer edges defined by rails that approach closer together from the top to the bottom of the whipstock, the method comprising introducing a mill guide into the wellbore above the whipstock, the mill guide having a top and a bottom and a channel therethrough from top to bottom, moving the mill guide into stabilizing contact with the whipstock and receiving a portion of the mill between the rails of the concave to facilitate mill stabilization and inhibit lateral milling, guiding a mill with the mill guide to mill down into the whipstock and through at least a longitudinal portion thereof, the mill having at least a portion thereof in contact with the mill guide while milling the at least a longitudinal portion of the whipstock.

4. The method of claim 3 wherein the mill is sufficiently long that when the portion of the mill is received between the rails of the concave at least an upper part of the mill is still in contact with the mill guide.

5. Wellbore apparatus comprising a whipstock with a top and a bottom, the whipstock disposed in a wellbore extending down from an earth surface into the earth, the wellbore having an inner surface, a mill guide with a body having an upper end, a lower end, and a channel therethrough from the upper end to the lower end, a portion of the lower end of the mill guide disposed between and held between the inner surface of the wellbore and an outer surface of the top of the whipstock, a tubular secured to the mill guide, and a mill releasably secured to the tubular.

6. The wellbore apparatus of claim 5 further comprising slip apparatus for selective preventing mill rotation, and selective clutching apparatus for selectively releasing the mill from the slip apparatus for milling.

7. The wellbore apparatus of claim 5 further comprising the mill guide having a guide barrel portion for guiding the mill.

8. The wellbore apparatus of claim 7 further comprising a sacrificial element disposed within the guide barrel to inhibit milling of the guide barrel.

9. The wellbore apparatus of claim 6 further comprising releasable apparatus interconnected with the slip apparatus for releasably holding the slip apparatus in a slip set position.

10. The wellbore apparatus of claim 5 wherein the mill has a lower end with ramped milling surfaces.

11. The wellbore apparatus of claim 5 wherein the mill comprises an outer mill body having a lower body milling surface, and an inner pilot mill selectively releasably secured to and within the outer mill.

12. The wellbore apparatus of claim 11 wherein the pilot mill has expandable apparatus connected thereto for engaging a member entered by the pilot mill.

13. The wellbore apparatus of claim 11 wherein the pilot mill is drivingly connected to the outer mill body.

14. Wellbore apparatus comprising a whipstock with a top and a bottom, the whipstock disposed in a wellbore extending down from an earth surface into the earth, the wellbore having an inner surface, a mill guide with a body having an upper end, a lower end, and a channel therethrough from the upper end to the lower end, and a portion of the lower end of the mill guide disposed between and held between the inner surface of the wellbore and an outer surface of the top of the whipstock, the mill guide positioned to guide a mill for milling the whipstock.

15. A method for stabilizing a mill guide in a wellbore extending from an earth surface into the earth, the wellbore having an inner surface, the method comprising setting a whipstock at a location in the wellbore, the whipstock having a top and a bottom, moving a mill guide down into the wellbore to contact the whipstock, the mill guide having a body with an upper end, a lower end, and a channel therethrough from the upper end to the lower end, and positioning the mill guide so that a portion of the lower end of the mill guide is received and held between the inner surface of the wellbore and an outer surface of the top of the whipstock and so that the mill guide is disposed to guide a mill for milling the whipstock.

16. A method for milling within a whipstock set in a wellbore extending from an earth surface down into the earth, the whipstock having a body with a top and a bottom, the method comprising introducing a mill guide into the wellbore above the whipstock, the mill guide having a lower portion, moving the mill guide into stabilizing contact with the whipstock, the lower portion of the mill guide in contact with the whipstock, the mill guide having a top and a bottom and a channel therethrough from top to bottom, guiding a mill with the mill guide to mill down into the whipstock and through at least a longitudinal portion thereof, the mill having at least a portion thereof in contact with the mill guide while milling the at least a longitudinal portion of the whipstock.

17. The method of claim 16 further comprising milling down through the bottom of the whipstock thereby opening a path from the wellbore above the whipstock to the wellbore therebelow.

18. The method of claim 16 wherein the mill is initially selectively releasably mounted to the mill guide, the mill having an upper end interconnected with a rotatable drill string extending from the mill upward to rotation apparatus at the earth surface.

19. The method of claim 16 wherein the whipstock has a central portion containing millable material.

* * * * *